US011670266B2

(12) United States Patent
Griffis

(10) Patent No.: US 11,670,266 B2
(45) Date of Patent: Jun. 6, 2023

(54) STAND FOR SUPPORTING A MUSICAL INSTRUMENT

(71) Applicant: Robert B. Griffis, Clearwater, FL (US)

(72) Inventor: Robert B. Griffis, Clearwater, FL (US)

( * ) Notice: Subject to any disclaimer, the term of this patent is extended or adjusted under 35 U.S.C. 154(b) by 0 days.

(21) Appl. No.: 17/470,052

(22) Filed: Sep. 9, 2021

(65) Prior Publication Data

US 2022/0076649 A1 Mar. 10, 2022

Related U.S. Application Data

(60) Provisional application No. 63/076,148, filed on Sep. 9, 2020.

(51) Int. Cl.
*G10D 3/00* (2020.01)
*G10G 5/00* (2006.01)

(52) U.S. Cl.
CPC ..... *G10G 5/00* (2013.01); *G10D 3/00* (2013.01)

(58) Field of Classification Search
CPC ..... G10G 5/00; G10D 3/00; G10D 1/08
See application file for complete search history.

(56) References Cited

U.S. PATENT DOCUMENTS 4,693,161 A 9/1987 Uhrig
5,036,974 A 8/1991 Ross, Jr.
5,197,701 A 3/1993 Olson
6,422,522 B1 * 7/2002 Woollen ..... G10G 5/00 211/85.6
8,440,894 B2 5/2013 Amland
8,637,752 B2 1/2014 Innocenti
10,535,329 B2 1/2020 Berg
2017/0316764 A1 11/2017 Snyder

FOREIGN PATENT DOCUMENTS

DE 202017004672 U1 3/2018

* cited by examiner

*Primary Examiner* — Kimberly R Lockett
(74) *Attorney, Agent, or Firm* — Lewellyn Law, PLLC; Stephen Lewellyn

(57) ABSTRACT

A musical instrument stand is detachably secured to a musical instrument and is movable from a stowed position into a deployed position to support the musical instrument in an upright orientation. The stand includes a low-profile track that is attached to the back of the instrument and an assembly that is configured to removably receive the track to secure the assembly to the musical instrument via the track. The assembly has a base member and a leg member that is pivotally attached to the base member at the tops thereof and is pivotal between the stowed and deployed positions. In the stowed position, the leg member lays against the base member. In the deployed position, the leg member forms together with the base member and instrument an A-frame like support for the instrument. The stand is low profile in relation to the musical instrument and does not interfere with the normal operation of the instrument.

20 Claims, 24 Drawing Sheets

STAND FOR SUPPORTING A MUSICAL INSTRUMENT

CROSS-REFERENCE TO RELATED APPLICATIONS

This application claims priority to U.S. Provisional Application 63/076,148, filed Sep. 9, 2020, and which is hereby incorporated herein by reference in its entirety.

FIELD OF THE INVENTION

The present disclosure relates to musical instrument stands and, more particularly, to stands that are removably attachable to musical instruments, such as, for example guitars and that provide for quick standing of a guitar without needing a separate guitar stand.

BACKGROUND OF THE INVENTION

Conventional musical instrument stands are designed to support and hold a musical instrument by placing the instrument on the stand. Conventional musical instrument stands have several deficiencies which make their use both cumbersome and inefficient. For example, these stands must be transported separately from the musical instrument, and thus they add to the amount of equipment which a musician typically must carry. And a common problem encountered by musicians is the temporary placement of their instrument when it is not being played during times when it is inconvenient to replace the instrument in its case. When the musician desires to take a short break from playing, or when the musician intends to play several instruments during a performance and needs quick and easy access to these various instruments. Additionally, conventional stands occupy a significant amount of space which is essentially wasted when the stands are not being used to support the instrument. Often these stands are used during a musical performance in a stage environment where space is rather limited and constitute additional obstacles about which the musicians must maneuver during a performance.

Accordingly, there is a need and a desire for a new musical instrument stand that can be removably attached to a musical instrument, such as, for example, a guitar and that allows convenient support of the guitar when not in use, is low profile so as not to interfere with playing the guitar, and is easily deployed for use and stowed when not being used.

SUMMARY OF THE INVENTION

Embodiments described herein provide a stand for supporting a musical instrument in an upright, standing position on a ground and that is removably attachable to the instrument by a low-profile track coupling arrangement.

It is an object of embodiments of the invention for the stand to provide a musician a convenient way to quickly set the instrument upright on the ground without fear of damaging the instrument or needing a separate stand to hold the instrument.

It is an object of embodiments of the invention for the stand to be easily installed and removed from the musical instrument.

In an embodiment, a musical instrument stand for supporting a musical instrument is provided. The stand has a low-profile track having an attachment surface carrying an adhesive layer for adhesively securing the track to a body of the musical instrument. A base member is configured to slidably receive the track to removably couple the base member and the track. A leg member is pivotally coupled to the base member and the leg member can be pivoted away from the base member to support the instrument in an upright standing position and pivoted toward the base member into a stowed position wherein the leg member lays flat against the base member and musical instrument.

In embodiments, the base member can have a latch that releasably engages with the track when the track is fully received by the base member to prevent the track and base member from decoupling.

In embodiments, the stand may further include a leg operator that is configured to automatically pivot the leg away from the base member when the instrument is placed in a standing position upon a ground surface. In embodiments, the leg operator has a shuttle that is slidably mounted to the base member for reciprocation along the base member in a longitudinal direction between first and second shuttle positions. The shuttle has a top end and a bottom end. A spring is mounted to the base member and biases the shuttle into the first position. A linkage is pivotally connected at one end to the top end of the shuttle and pivotally connected at a second end to the leg member.

Moving the shuttle from the first position to the second position operates the linkage thereby causing the leg member to pivot away from the base member and instrument. The shuttle is automatically moved by the bottom end of the shuttle contacting the ground as the instrument is placed on the ground. The shuttle is automatically retuned to its first position by the spring force when the instrument is lifted from the ground, thereby causing the leg member to fold or pivot back against the base member.

Numerous additional objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature or a feature with similar functionality. In the drawings:

FIG. 20 is a cross-sectional view of the base member taken along line 20-20 in

FIG. 18;

FIG. 21 is a top view of the track of FIG. 20;

DETAILED DESCRIPTION

Figure 1:
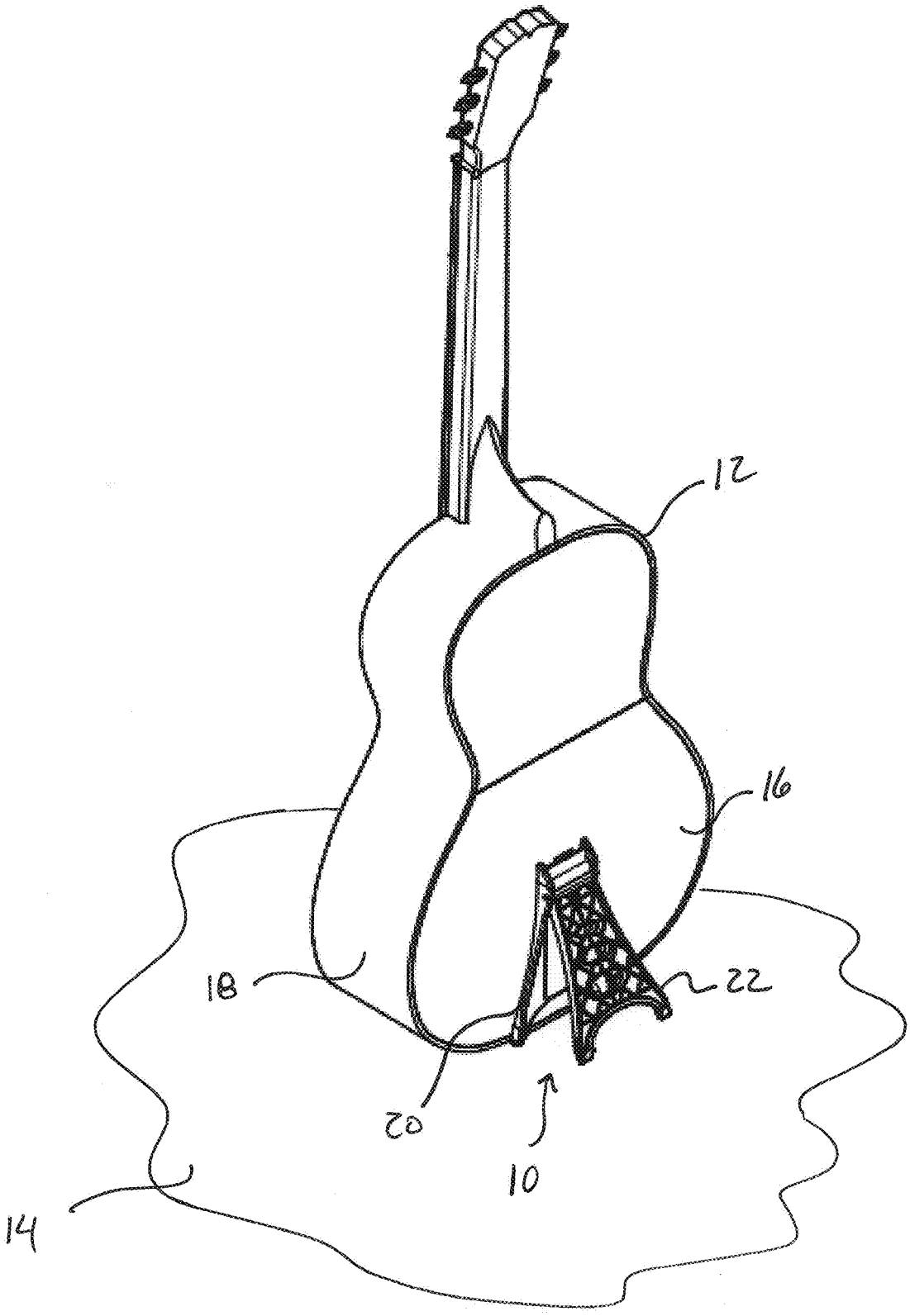
FIG. 1 is perspective view of a musical instrument stand that is provided in accordance with embodiments of the invention, shown in use in connection with a musical instrument, representatively a guitar, and supporting the instrument in an upright position on the ground.
Figure 2:
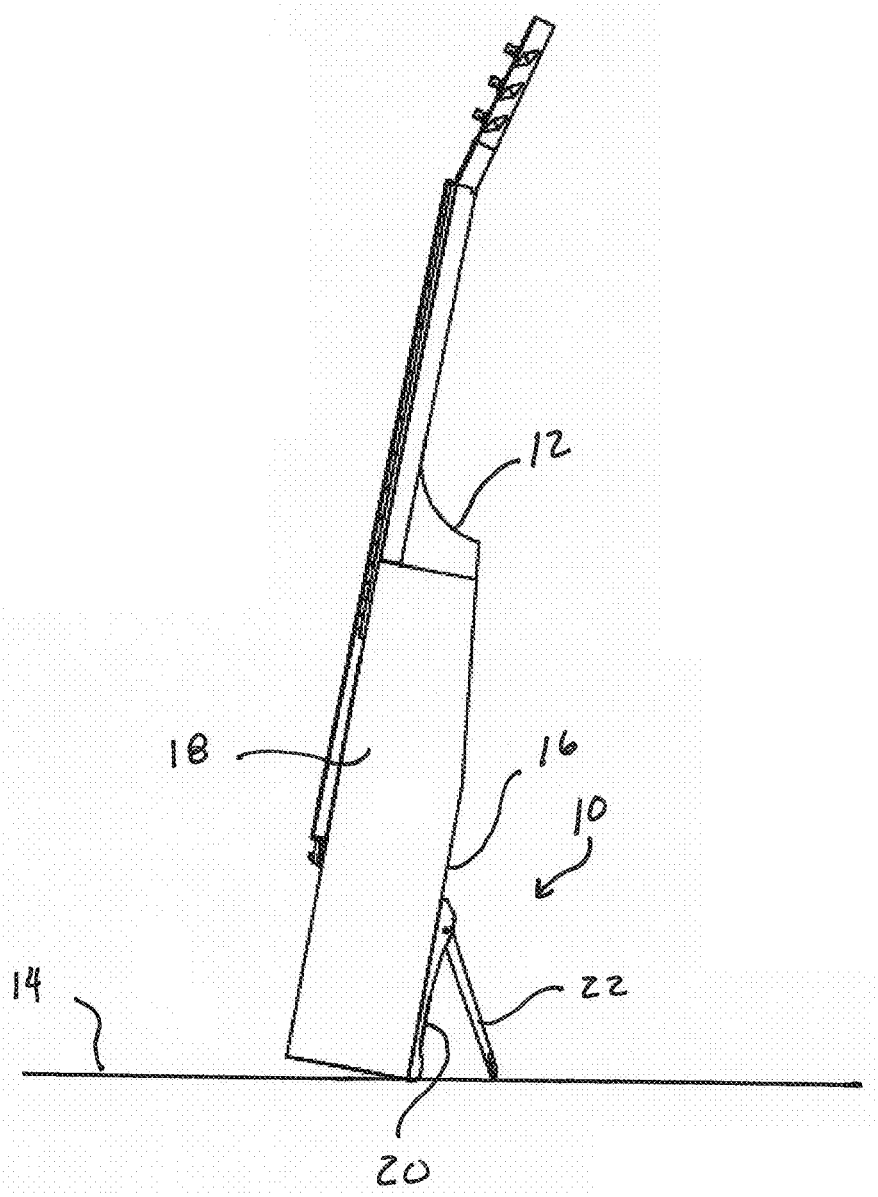
FIG. 2 is a side view of the musical instrument stand and musical instrument of FIG. 1.

With initial reference to FIGS. 1 and 2, there is illustrated a musical instrument stand 10 embodying the principles and concepts of an embodiment of the invention. The stand 10 is shown in use in connection with a guitar 12 and shown in the deployed or operating position, supporting the guitar in an upright, standing position upon a support surface 14. Particularly, stand 10 is attached to the back surface 16 of the guitar body 18 toward the bottom end of thereof.

Stand 10 has a base member 20 that is removably attached to the back surface 16 of the guitar body 18 by a track, which is described further herein, and a leg member 22 that is pivotally connected to the base member 20. The leg member 22 is pivotal between a deployed position, as shown, and a stowed position. In the deployed position the leg member 22 is pivoted away from the guitar body 16 providing an A-frame like stand configuration to support the guitar 12 in the standing position. In the stowed position, the leg member 22 is disposed generally flat against the guitar 12.

Figure 3:
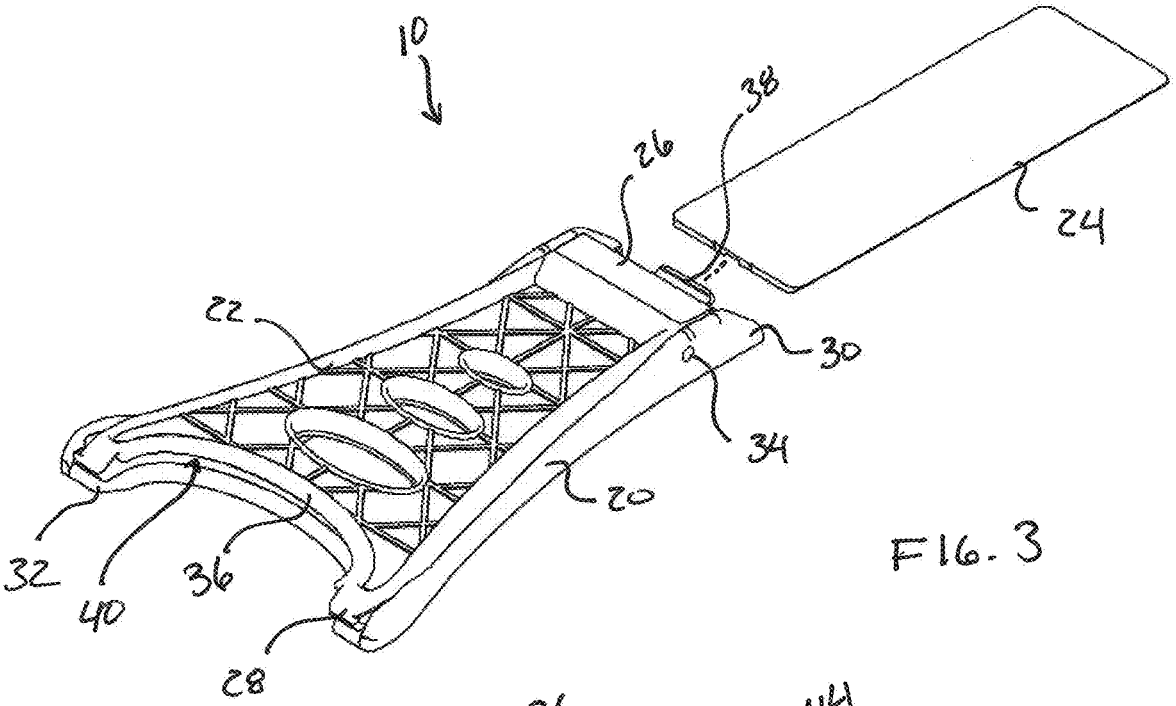
FIG. 3 is a perspective view of a musical instrument stand that is provided in accordance with embodiments of the invention, showing a low-profile track removed from engagement with a base member, also shown is a leg member in a stowed position against the base member.

In FIG. 3 there is illustrated a perspective, partial exploded view of the stand 10. Base member 20 is shown together with the leg member 22 in the stowed or folded closed position where the leg member 22 lay against the base member. Further shown is a track 24 exploded from the base member 20.

Leg member 22 has a top end 26, a bottom end 28 and a length extending therebetween. Base member 20 has a top end 30, a bottom end 32 and a length extending therebetween. The top end 26 of the leg member 22 is pivotally attached to the top end 30 of the base member 20 at pivot coupling 34. In this manner, the leg member 22 can pivot toward and away from the base member 20 or the musical instrument when attached to a musical instrument. The bottom of the leg member 22 has a lip 36 for gripping to pull the leg member outward into the deployed position.

As discussed in further detail below, the track 24 is configured to adhesively mount or attach to the guitar body 16 and the base member 20 is configured to slidably receive the track to removably couple the base member to the track, thereby removably attaching the base member to the guitar body. The track 24 is generally planar and has a thin or low-profile configuration with a length much greater than its thickness. In embodiments, the thickness of the track 24 is about 3 mm or ⅛ inch thick. The track's low-profile configuration prevents the track from interfering with handling the guitar and does not detract from the guitar's appearance.

The base member 20 may further have a catch or latch 38 at its top end 30 that engages with a top edge of the track 24 when the track is fully received by the base member. The latch 38 locks the base member 20 and track 24 together by stopping the track from sliding out of the base member. In embodiment, the latch 38 is resilient and may be made integrated with the base member 20. Lifting upwardly or in a direction away from the track 24 disengages the latch and allows decoupling of the track from the base member 20.

As further depicted, the base member 20 has side walls that define a recess or space 40 into which the leg member 22 is received when the leg member is in the folded, stowed position laying against the base member.

Figure 4:
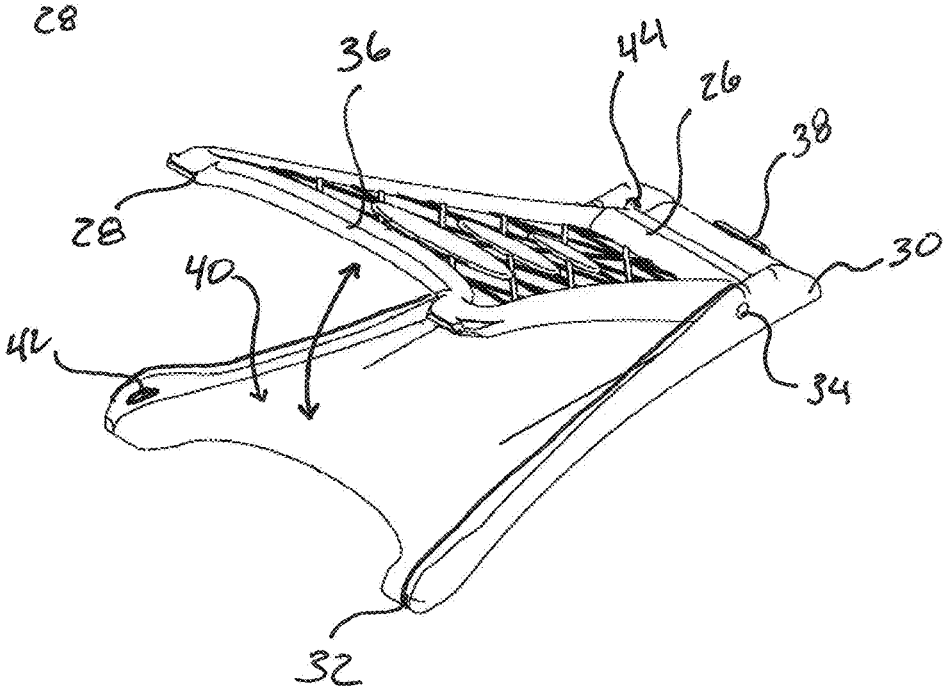
FIG. 4 is a perspective view of a musical instrument stand that is provided in accordance with embodiments of the invention, showing a leg member in a deployed position, pivoted away from a base member.

In FIG. 4 there is a perspective view of the base member 20 and the leg member 22 showing the leg member in the outward, deployed position. Further shown is the recess 40 into which the leg member is disposed when in the folded, stowed position. The base member 20 may further include detents 42 that engage with the sides of the leg member 22 toward the bottom 28 thereof when the leg member is in the folded, stowed position to releasably hold the leg member in the folded position. The detents 42 are disposed on the inner side of each side wall of the base member toward the bottom 32 of the base member, only one is visible here, but the other is in the same location on the other side wall. The base member 20 may further include detents 44 that engage with the sides of the leg member 22 toward the top 26 thereof when the leg member is in open, deployed position to releasably hold the leg member in the open position. The detents 44 are disposed on the inner side of each side wall of the base member toward the bottom 38 of the base member, only one is visible here, but the other is in the same location on the other side wall.

Figure 5:
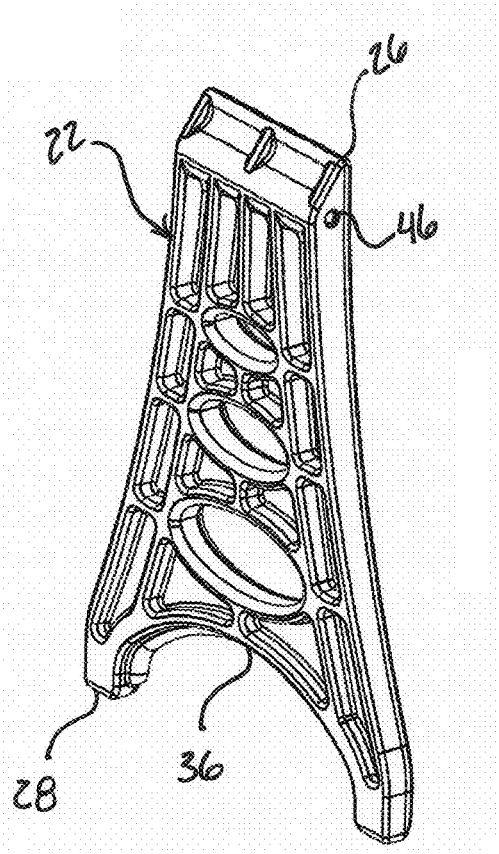
FIG. 5 is a perspective view of a leg member that is provided in accordance with embodiments of the invention.

In FIG. 5 there is a perspective view of a leg member 22 according to an embodiment of the invention. As depicted, the member has a top 26, a bottom 28 and a length extending there between. The leg member 22 can be made of plastics, and preferably a high strength plastic. However, the leg member could be made of other materials like metal, alloys, etc. As further shown, the bottom 28 is generally arcuate shaped and has two opposed feet-like portions upon which the leg member rests when used to support a music instrument. The arcuate shaped portion includes a lip 36 for gripping to move the leg member 22 from the stowed to deployed position. At the top 26, the leg member 22 has a passage 46 for the pivotal coupling between the leg member and the base member.

Figure 6:
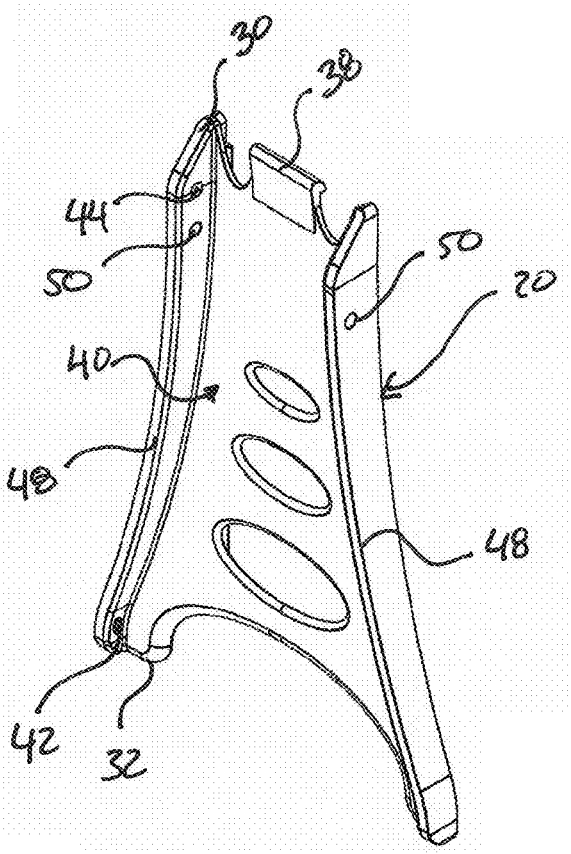
FIG. 6 is a perspective view of a base member that is provided in accordance with embodiments of the invention.

In FIG. 6 there is a perspective view a base member 20 according to an embodiment of the invention. As depicted, the base member 20 has a top 30, a bottom 32, and a length extending therebetween. The base member 20 can be made of plastics, and preferably a high strength plastic. However, the base member could be made of other materials like metal, alloys, etc.

The base member 20 also has sidewalls 48 that define a recess or space 40 into which the leg member 22 is received or disposed when the leg member is in the folded, stowed position. In this manner, the stand has a relatively low profile against the musical instrument to which it is attached. Further depicted are detents 42 (only one is visible) that are located on the inner side of the sidewalls 40 toward the bottom 32 of the base member. Detents 42 operate to engage with the leg member 22 when in the folded, stowed position to retain the leg member in that position. Also seen are detents 44 (only one is visible) that are located on the inner side of the sidewalls 40 toward the top 30 of the base member 20. Detents 44 operate to engage with the leg member 22 when in the deployed position to retain the leg member in that position.

Base member 20 may also have a latch or catch 38 at its top 30 for engagement with the track 24 when the base member and the track are fully coupled. In the represented embodiment, the catch 38 is formed integral with the base member 20 and is of a resilient configuration allowing the catch to bend slightly during engagement and disengagement with the track. Particularly, the base member 20 is configured to slide onto the track or sliding receive the track in a direction from the top 30 toward the bottom 32. When the track 24 is fully received by the base member 20 the catch 38 engages a lateral edge of the track and prevents or restrains the track from moving in the opposite direction, thereby securely coupling the track and base member. The track 24 is released by simply pulling up on the catch 38 with a finger.

In the representatively illustrated embodiment, the base member 20 has apertures 50 formed through the sidewalls 48 for the pivotal coupling with the leg member 22. The pivotal coupling could be a pivot pin, thread fasteners, or another structure that pivotal couples the leg member and the base member. Also, as shown, and like the leg member 22, the base member 20 may have an arcuate-shaped portion at its bottom 32.

Figure 7:
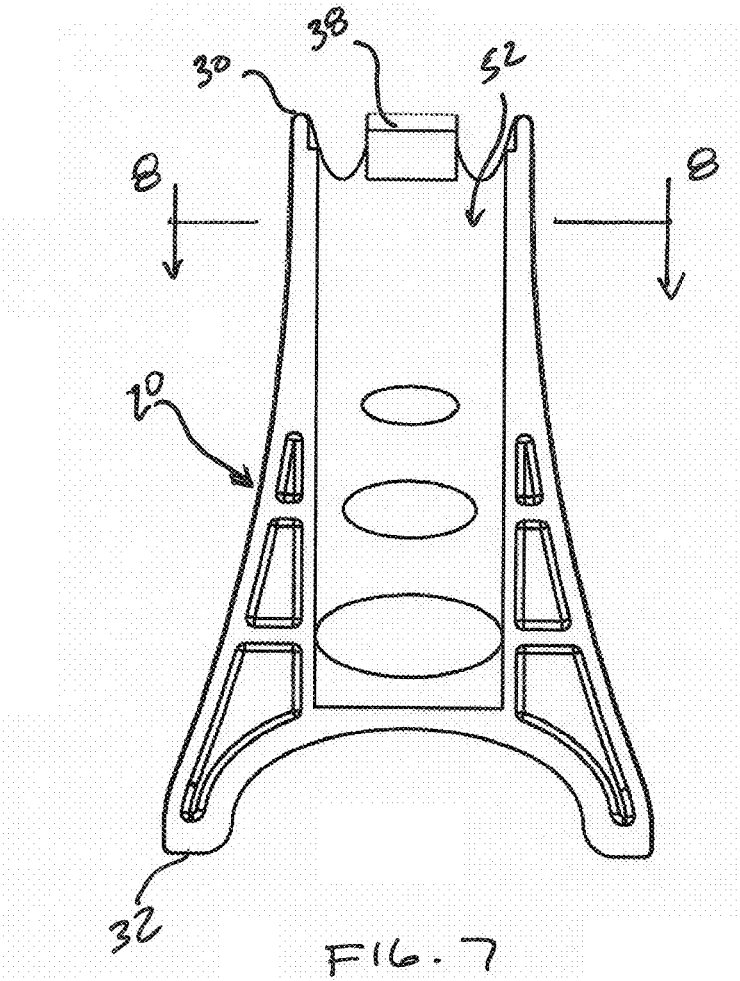
FIG. 7 is a back view of the base member of FIG. 6.

In FIG. 7 there is a back view of the base member 20 according to an embodiment of the invention. As depicted, the base member 20 has a slot 52 for receiving the track 24. The slot 52 is open at the top 30 of the base member and terminates at a closed end toward the bottom 32 of the base member. Further shown is in the catch 38 that engages with the track 24 when the track is fully received into the slot 52 to prevent the track from backing out of the slot or a decoupling of the base member and track.

Figure 8:
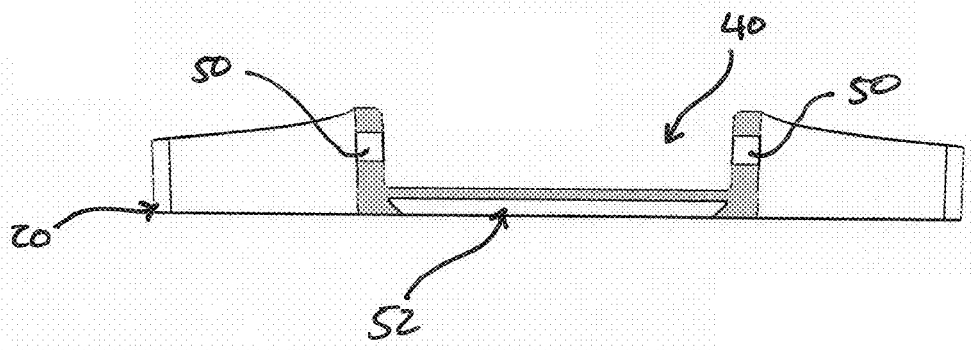
FIG. 8 is a cross-sectional view of the base member taken along line 8-8 in FIG. 7.

In FIG. 8 there is a cross-sectional view of the base member 20 taken along line 8-8 in FIG. 7. The slot 52 can be configured to have a dovetail-like cross-section that complements the track profile to securely retain the track in the slot. It should be noted, however, other slot profiles could be used to achieve the same result of sliding coupling the track and the base member and the profile should not be limited to just a dovetail-like coupling between the track and the base member.

Figure 9:
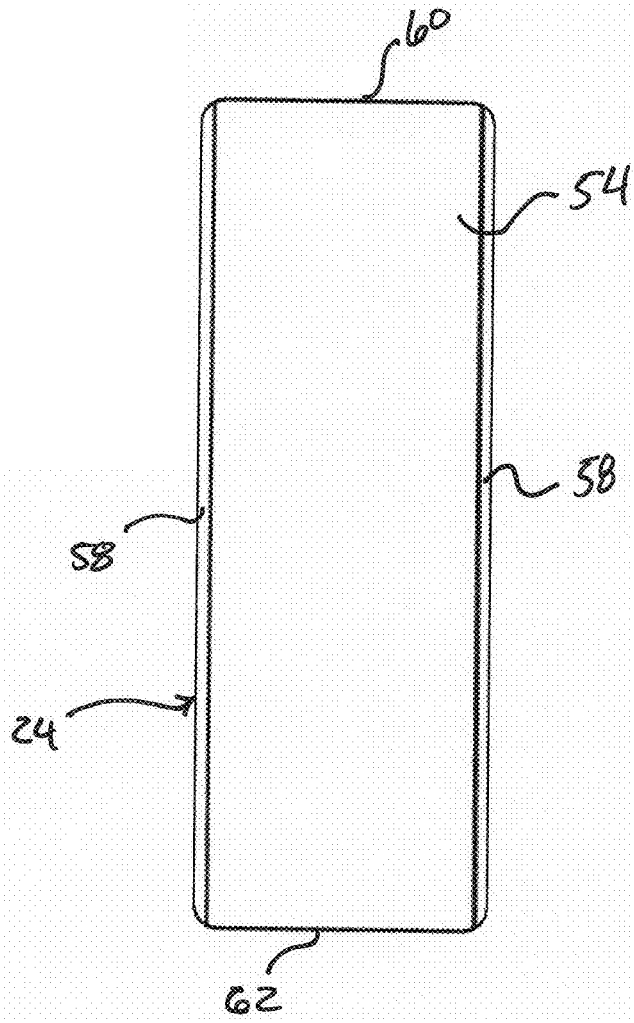
FIG. 9 is a back view of a track that is provided in accordance with embodiments of the invention.
Figure 10:
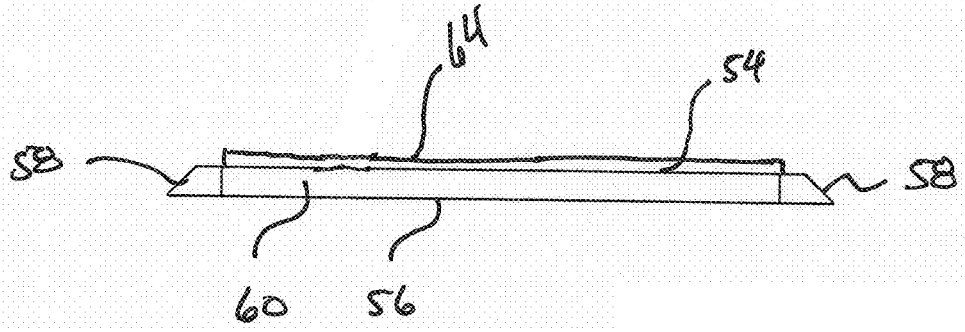
FIG. 10 is a top view of the track of FIG. 9.

In FIGS. 9 and 10 there is shown a track 24 in accordance with an embodiment of the invention. Track 24 has an elongated configuration with a length greater than its width. The track 24 is also of a thin profile and in some embodiments may have a thickness of about 3 mm or ⅛ inch thick. The track 24 can be made of plastics, and preferably a high strength plastic. However, the track could be made of other materials like metal, alloys, etc.

The track 24 has a broad mounting surface 54, an opposite outward facing surface 56, opposite longitudinal edges 58, a top edge 60, and a bottom edge 62. The longitudinal edges 58 taper from the mounting surface toward the outward surface to conform or compliment the dovetail-like profile of the slot 52 in the base member 20. An adhesive layer 64 is on the mount surface 54 and is used to adhesively secure or attach the track 24 to the body of a musical instrument. In embodiments, the adhesive layer can be a pressure sensitive and have a protective release layer that is removed for attaching the track the musical instrument. In embodiments, the adhesive layer may be a stretch release type adhesive making removing the track from the musical instrument easier and without damage to the musical instrument.

Figure 11:
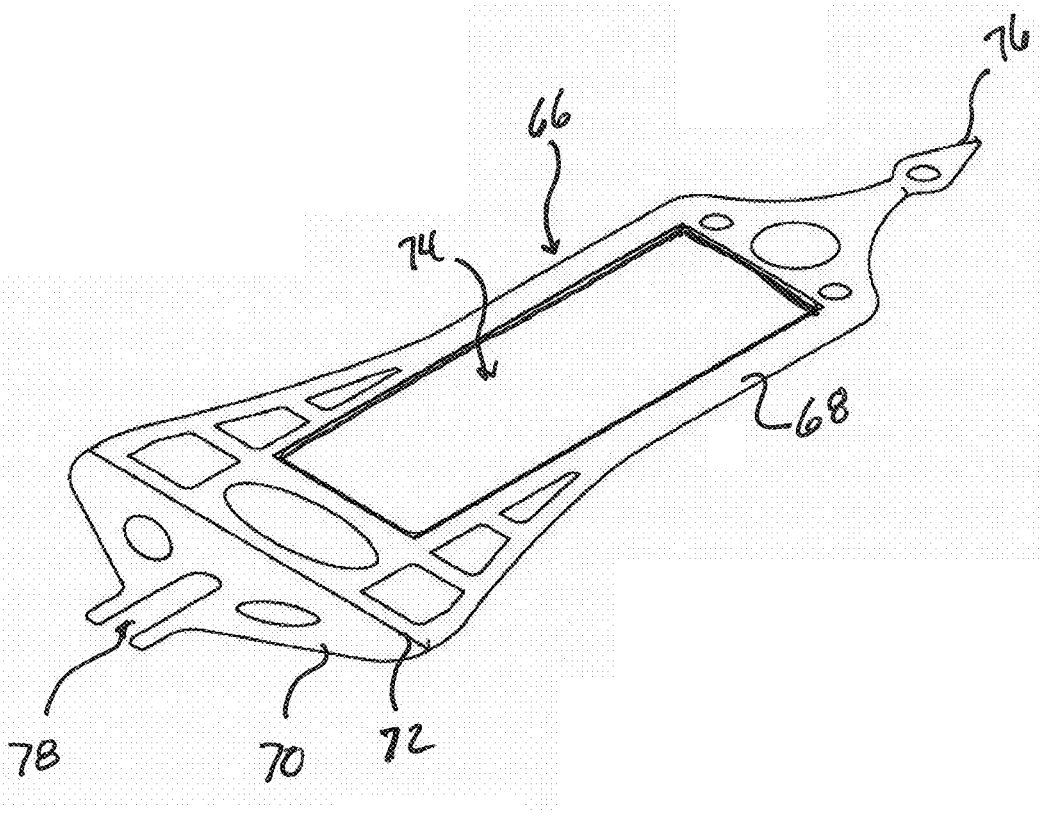
FIG. 11 is a perspective view of a track mounting template that is provided in accordance with embodiments of the invention.

In FIG. 11 there is a perspective view of a template 66 used for aligning and attaching the track 24 to the body of a musical instrument in accordance with an embodiment of the invention. The template 66 has a thin profile with an upper or first portion 68 and a lower or second portion 70 that is hinged relative to the upper portion by living hinge 72.

The upper portion 68 has an opening 74 that is sized to correspond to the dimension of the track 24. The upper portion 68 also has a point 76 that is used to help center the template on the musical instrument body, as will be explained in further detail below. The lower portion 70 has an alignment opening or slot 78 that is used to align the template with a shoulder strap coupling that is located on the bottom of the musical instrument, as will be explained in further detail below.

Figure 12:
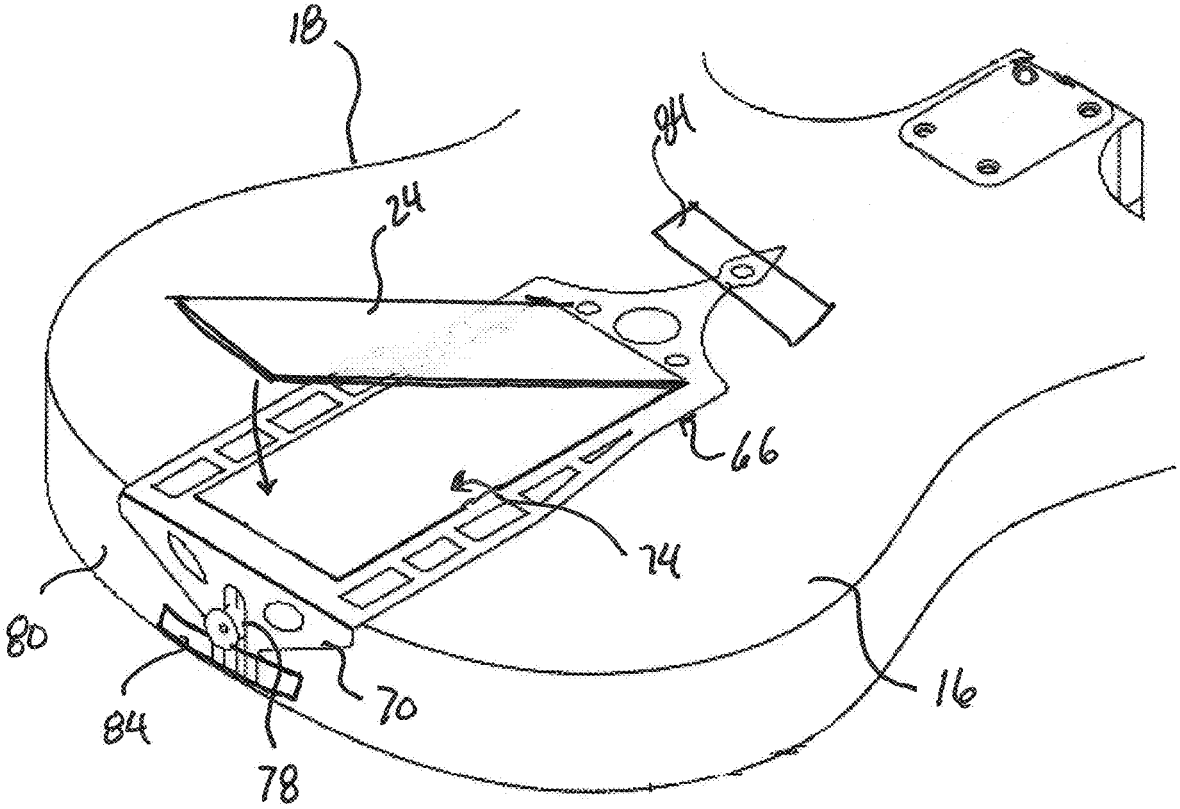
FIG. 12 is a perspective view showing a track being mounted to the back of a musical instrument using the track mounting template.

In FIG. 12 there is a perspective view showing the template 66 in use for attaching the track 24 to the back 16 of the musical instrument body 18, representatively shown as a guitar. The template 66 is arranged on the back 16 of the musical instrument with the upper portion 68 on the back and the lower portion folded over onto the bottom 80 of the musical instrument. The lower portion is aligned with the shoulder strap coupling 82 by positioning the coupling in slot 78. The upper portion 68 is aligned with the center of the back 16 using point 76. The template 66 can be temporality secured in place by using adhesive tape 84.

Once the template 66 is properly aligned, the track 24 can be secured or mounted to the back 16 by aligning it with the opening 74 in the template and pressing it down onto the back to firmly adhere the track to the back by the adhesive. Once the track 24 is mounted, the template can be removed.

Figure 13:
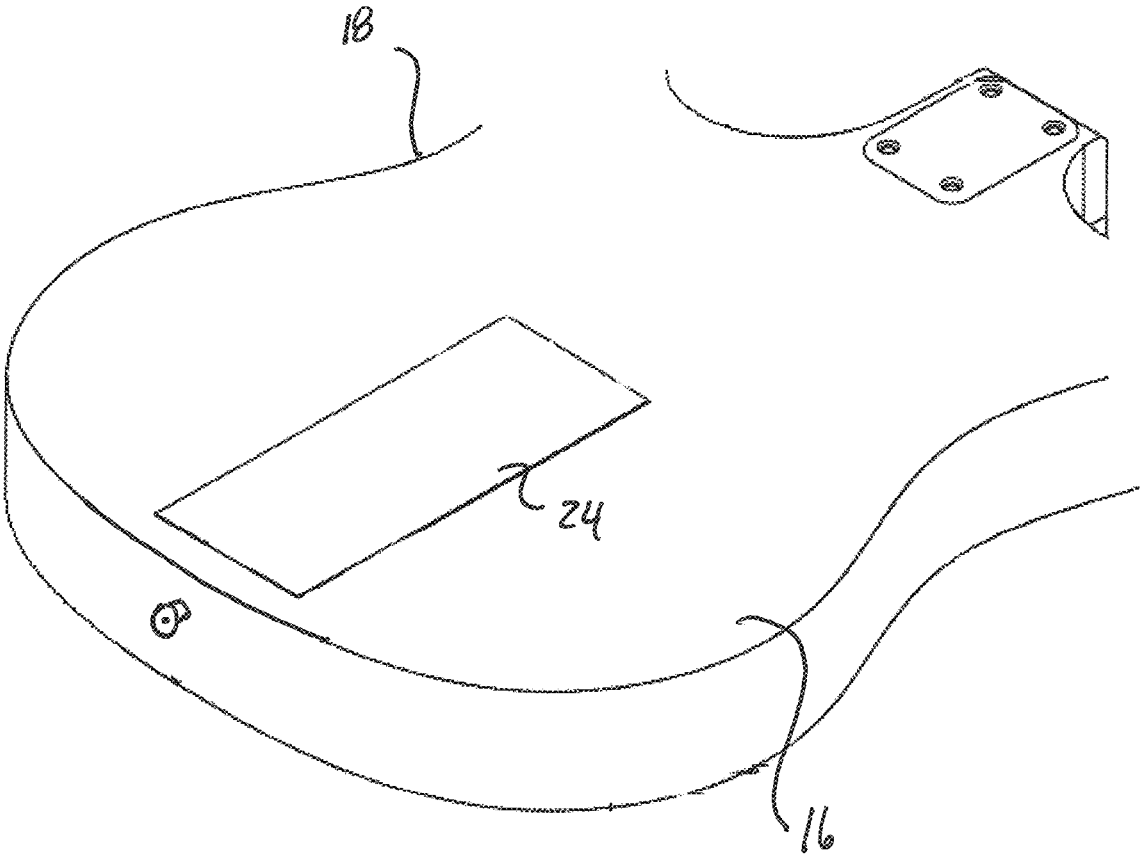
FIG. 13 is a perspective view showing a track mounted to the back of a musical instrument.
Figure 14:
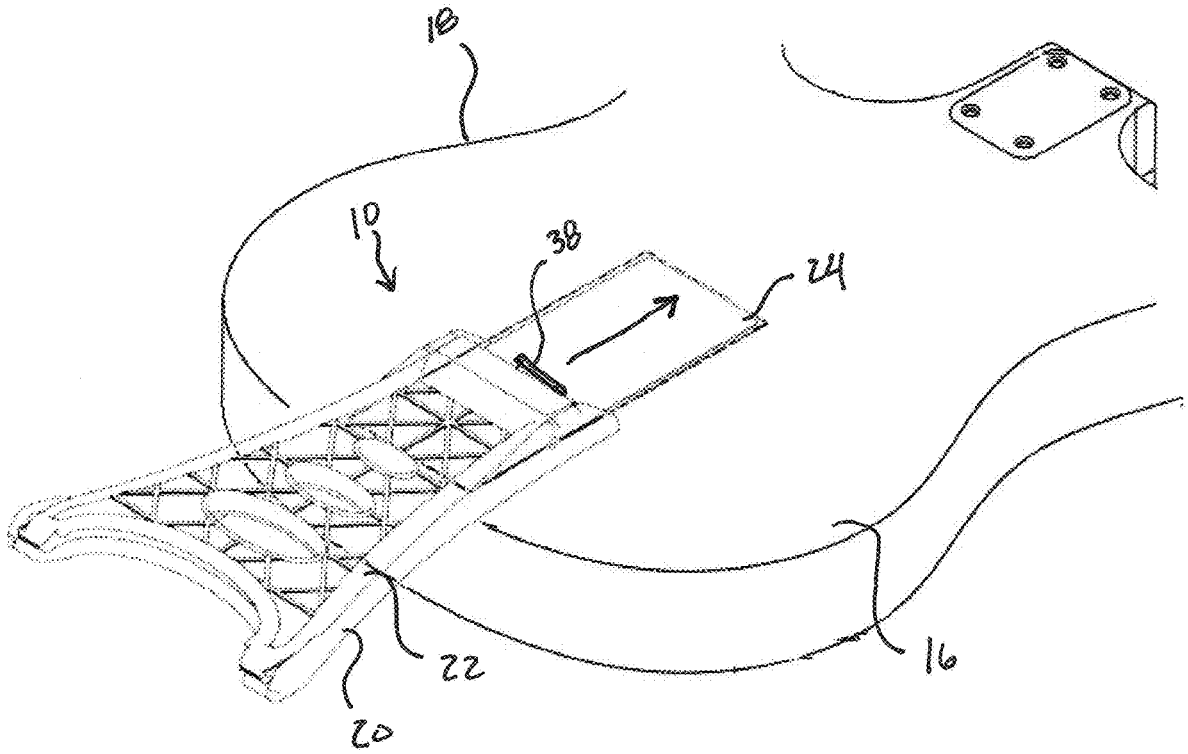
FIG. 14 is a perspective view showing the stand being coupled to a mounting track that is mounted to the back of a music instrument.

In FIG. 13 the musical instrument is shown with the track 24 mounted to its back 16. In FIG. 14 the base member 20 is shown being coupled to the track 24 by sliding the track into the track slot 52 (not visible here). The base member is slide onto the track 24 with the track being received by the base member in the slot until the track is fully seated and the latch 38 snap locks into engagement with the top edge of the track.

Figure 15:
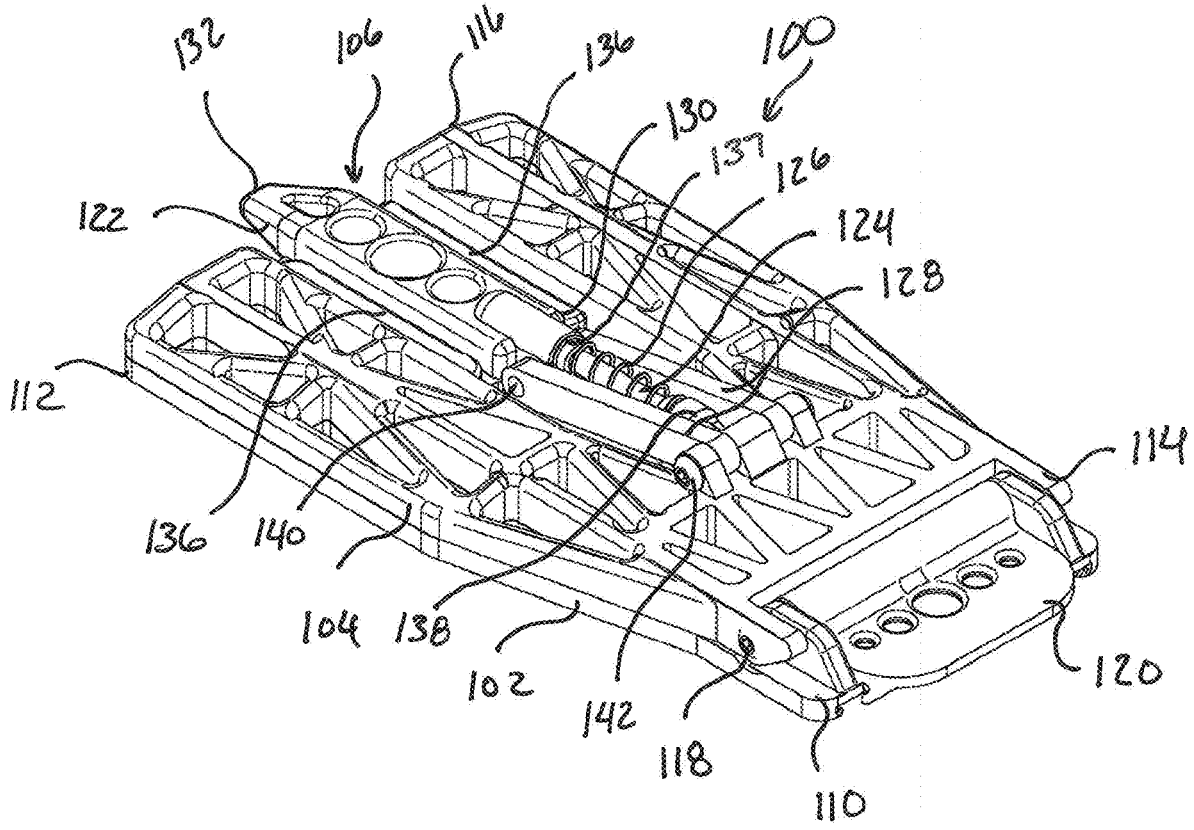
FIG. 15 is a perspective view of a musical instrument stand that is provided in accordance with other embodiments of the invention.
Figure 16:
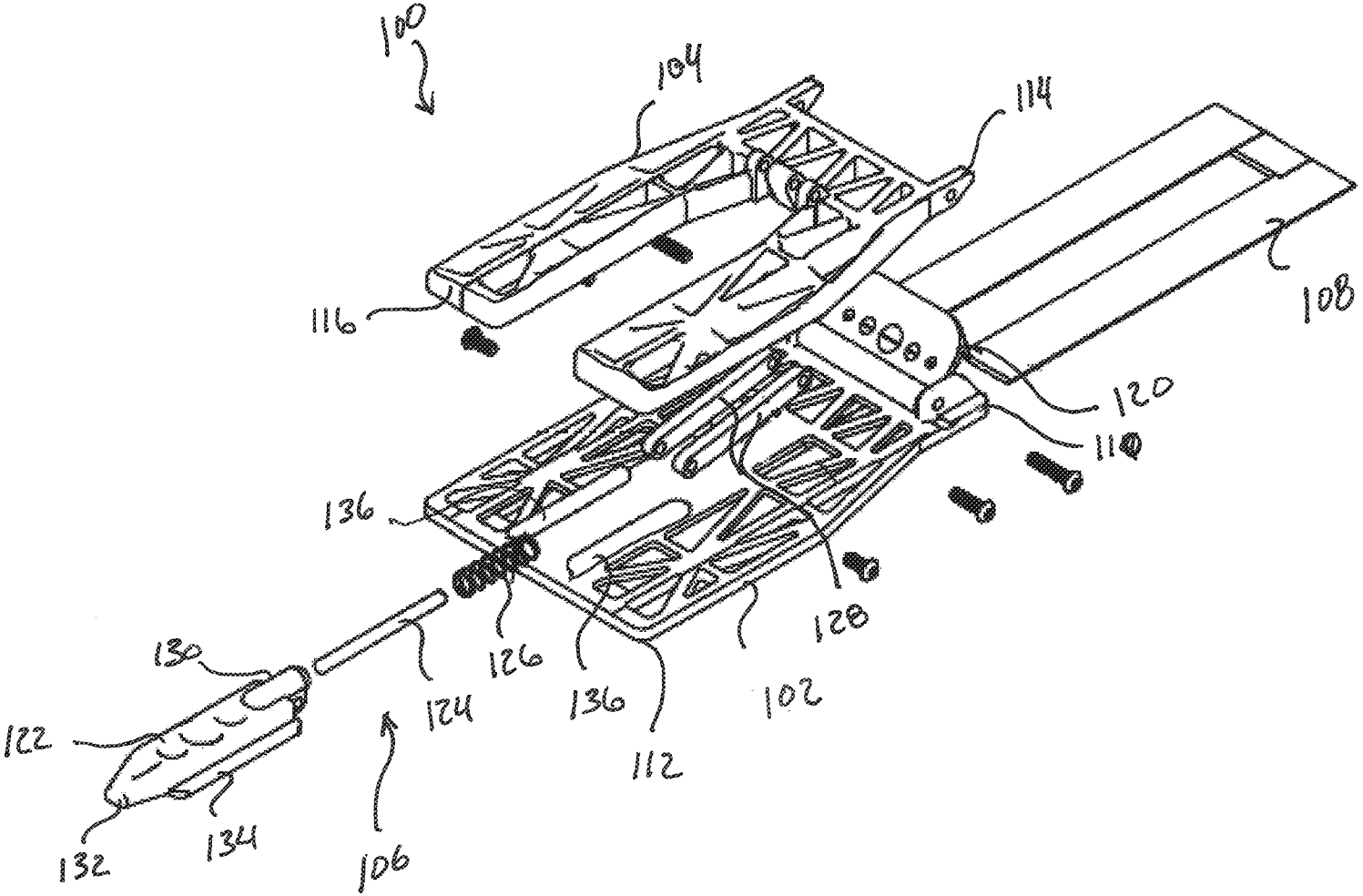
FIG. 16 is an exploded perspective view of the stand of FIG. 15.

In FIGS. 15 and 16 there is illustrated a musical instrument stand 100 according to another embodiment of the invention. Stand 100 is like stand 10 discussed above, but it operates automatically to deploy the legs when the music instrument to which it is attached is stood up on a ground surface. As depicted, stand 100 includes a base member 102, leg member 104, a leg operator assembly 106, and a track 108.

Base member 102 has a top end 110, a bottom end 112 and a length extending therebetween. Leg member 104 has a top end 114, a bottom end 116 and a length extending therebetween. The top end 114 of the leg member 104 is pivotally attached to the top end 110 of the base member 102 at pivot coupling 118. In this manner, the leg member 104 can pivot toward and away from the base member 102 or the musical instrument when attached to a musical instrument.

Track 108, like track 24, is configured to adhesively mount or attach to the guitar body 16 and the base member 102 is configured to slidably receive the track to removably couple the base member to the track, thereby removably attaching the base member to the guitar body. The track 108 is generally planar and has a thin or low-profile configuration with a length much greater than its thickness. In embodiments, the thickness of the track 108 is about 3 mm or ⅛ inch thick. The track's low-profile configuration prevents the track from interfering with handling the guitar and does not detract from the guitar's appearance.

The base member 102 may further have a catch or latch 120 at its top end 110 that operates to lock the base member and track 108 together by stopping the track from sliding out of the base member. In embodiment, the latch 120 is pivotally attached to the base member 102 at pivotal coupling 118. The latch 120 is configured to snap lock with the top edge of the base member 102 when rotated toward the track and has an engagement surface 185 (FIG. 27) that blocks from sliding decoupling from the base member. Lifting upwardly or in a direction away from the track 108 disengages the latch and allows decoupling of the track from the base member 102.

The leg operator assembly 106 includes a shuttle 122, a shaft 124, a spring 126, and a linkage, representatively shown as a pair of link arms 128. The shuttle 122 is slidably attached to the base member 104 for reciprocation in a direction between the top and bottom ends thereof. In the representatively illustrated embodiment, the shuttle 122 has an inward end 130 and an outward or contact end 132 and a body extending therebetween. Slides 134 are disposed on opposite sides of the body and extend along its longitudinal length. The shuttle 122 is slidably attached to the base member 104 with the slides 134 slidingly received in corresponding slide tracks 136 disposed on the base member 102.

The inward end 130 of the shuttle 112 has a blind bore 137 for receiving an end of the shaft 124. The opposite end of the shaft is slidably received by a boss 138 (best seen in FIG. 18) on the base member 102. The spring 126 is captively held on about the shaft 124 between the shuttle 112 and the boss 138 and operates to bias the shuttle in a direction toward the bottom end of the base member 102. The shaft 124 operates to retain the spring and it makes the shuttle 112 operation smooth and stable by keeping it aligned in the slide tracks 136 and provides support and relief from the diagonal forces that link arms 128 apply to the top of the shuttle.

The operator assembly 106 is held together by the link arms 128 which are pivotally attached at one end to the shuttle a pivot coupling 140 and pivotally attached at the other end to the leg member 104 at pivot coupling 142. The leg member 104 is bifurcated into two legs that are separated by a space, the operator assembly 106 is received in this space when the leg member is in the stowed position.

In operation, when the shuttle 112 is moved in a direction toward the top end of the base member 102 (i.e., against the spring force), the shuttle moves the pivot coupling 140 toward the pivot coupling 142 which causes the link arms to apply a force to the leg member 104 causing the leg member to swing or pivot outwardly into the deployed position. When the force is removed from the shuttle 112 and the spring 126 biases the shuttle in the opposite direction, an opposite force is applied to the leg member 104 and the leg member is caused to swing or pivot inwardly toward the base member into the stowed position.

To this end, when the stand 100 is mounted to the musical instrument, the stand automatically operates to deploy the leg member 104 to support the musical instrument on the ground as the shuttle engages with the ground and is moved against the spring force by the weight of the musical instrument. When the instrument is lifted from the ground, the force provided by spring 126 causes the shuttle to move in the opposite direction and pivot the leg member 104 inwardly against the base member 102 and into the stowed position.

As seen in FIG. 16, the pivot couplings 140 and 142 can be assembled with threaded fasteners as shown, but also could be assembled by pins, or the like structure that provides for a pivot coupling between the respective components.

Figure 17:
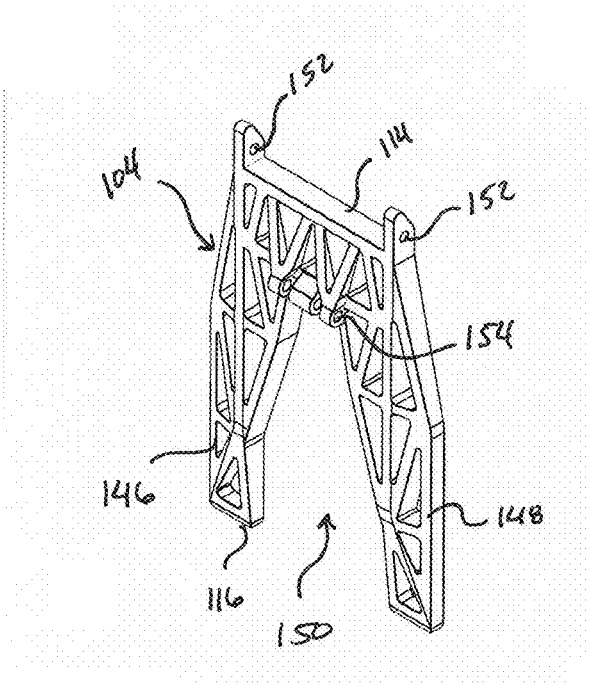
FIG. 17 is a perspective view of a leg member of the stand of FIG. 15 and is provided in accordance with embodiments of the invention.

In FIG. 17 there is a perspective view of the leg member 104 according to an embodiment of the invention. As depicted, the leg member is generally planar and has a top 114, a bottom 116 and a length extending there between. The leg member 104 can be made of plastics, and preferably a high strength plastic. However, the leg member could be made of other materials like metal, alloys, etc. As further shown, the leg member 104 includes two legs 146 and 148 that are separated by a space 150. The space 150 is where the operator assembly 106 is disposed as discussed above. At the top 114, the leg member 104 has a passage 152 for the pivotal coupling between the leg member and the base member. The leg member 104 further has passages 154 for pivot coupling 142 with the link arms 128.

Figure 18:
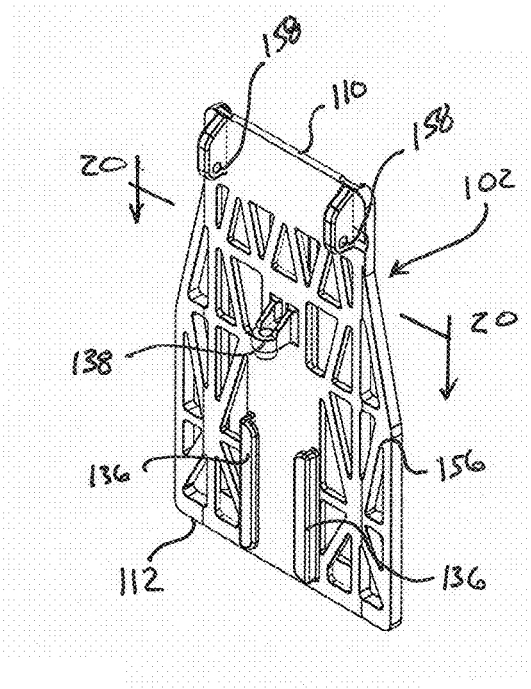
FIG. 18 is a perspective view of a base member of the stand of FIG. 15 and is provided in accordance with embodiments of the invention.

In FIG. 18 there is a first perspective view of the base member 102 according to an embodiment of the invention. As depicted, the base member 102 is generally planar and has a top 110, a bottom 112, and a length extending therebetween. The base member 20 can be made of plastics, and preferably a high strength plastic. However, the base member could be made of other materials like metal, alloys, etc.

The base member 102 has the slide tracks 136 on its front or first side 156. As discussed above, the slide tracks are configured to slidingly receive the slides on the shuttle 122. The shaft boss 138 is disposed between the top and bottom ends and toward the top end in reference to the slide tracks. The base member further has passages 158 at its top end for the pivot coupling 118 with the leg member 104.

Figure 19:
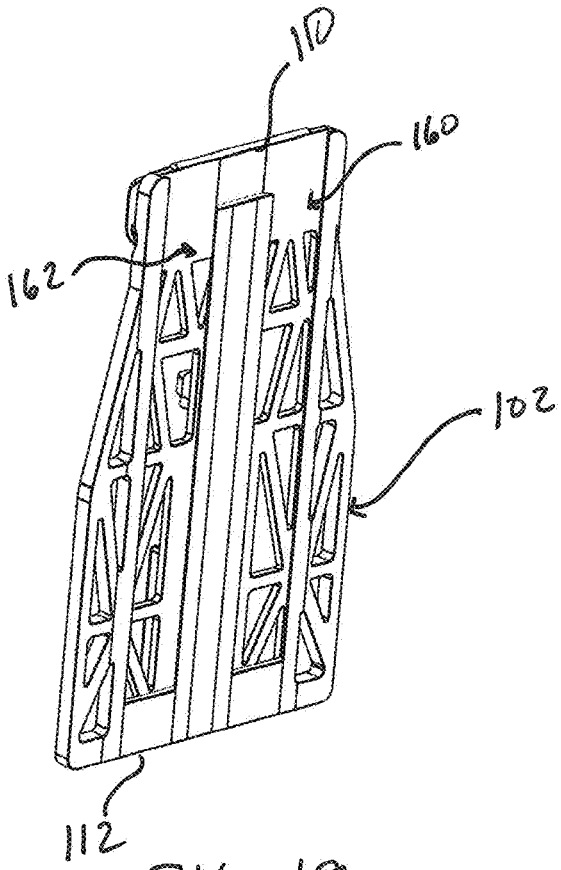
FIG. 19 is a second perspective view of the base member of FIG. 18.

In FIG. 19 there is a second perspective view of the base member 102 showing the back or second side, which is opposite the front side. As seen here, the base member 102 includes slots 160 and 162 for slidably receiving the track 108 therein to couple the base member to the track. As depicted, the track 108 (best seen in FIG. 16) has includes two parallel track members that are slidably receivable by the slots 160 and 162. It is important to note, however, track 108 could be substituted with track 24 and the base member 102 with a single slot like the slot 52 of base member 20, described above. Slots 160 and 162 are s open at the top 110 of the base member and terminate at a closed ends toward the bottom 112 of the base member.

Figure 20:
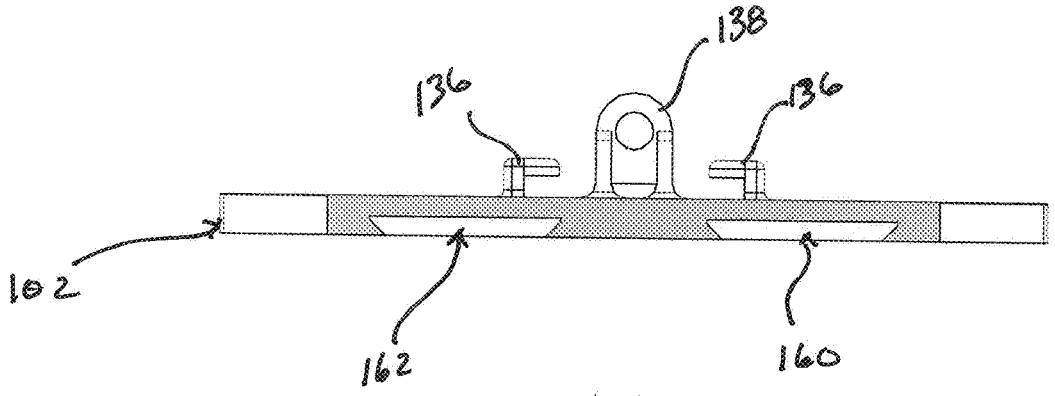

In FIG. 20 there is a cross-sectional view of the base member 102 taken along line 20-20 in FIG. 18. The slots 160 and 162 can each be configured to have a dovetail-like cross-section that complements the track profile to securely retain the track in the slot. It should be noted, however, other slot profiles could be used to achieve the same result of sliding coupling the track and the base member and the profile should not be limited to just a dovetail-like coupling between the track and the base member. Further shown here are the slide tracks 136 that are configured to slidably receive the shuttle 132 and the shaft boss 138 for receiving an end of the shaft 124.

Figure 21:
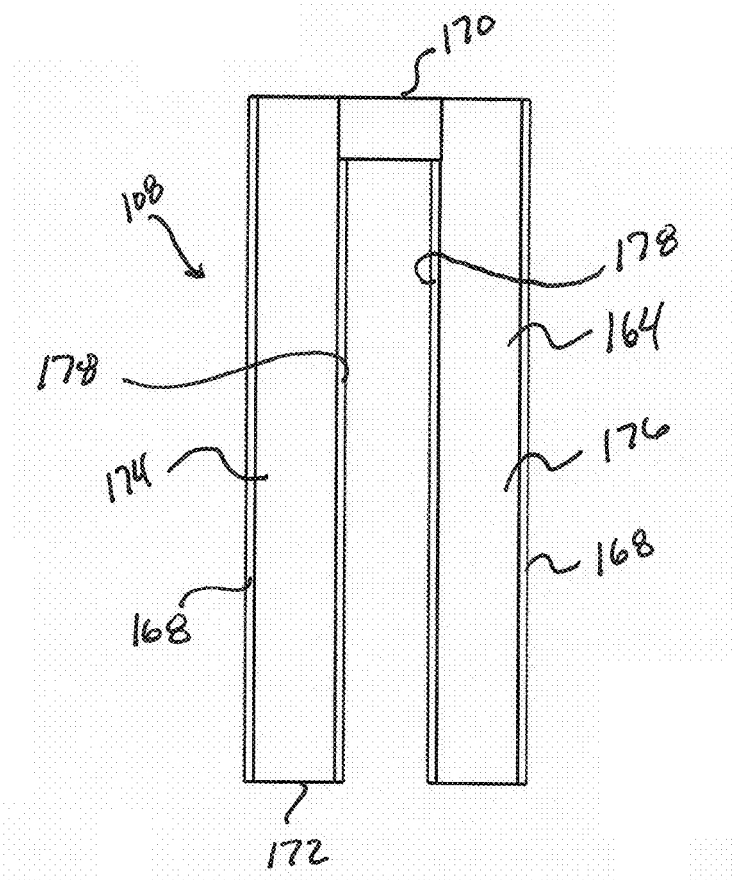
FIG. 21 is a back view of a track that is provided in accordance with embodiments of the invention.
Figure 22:
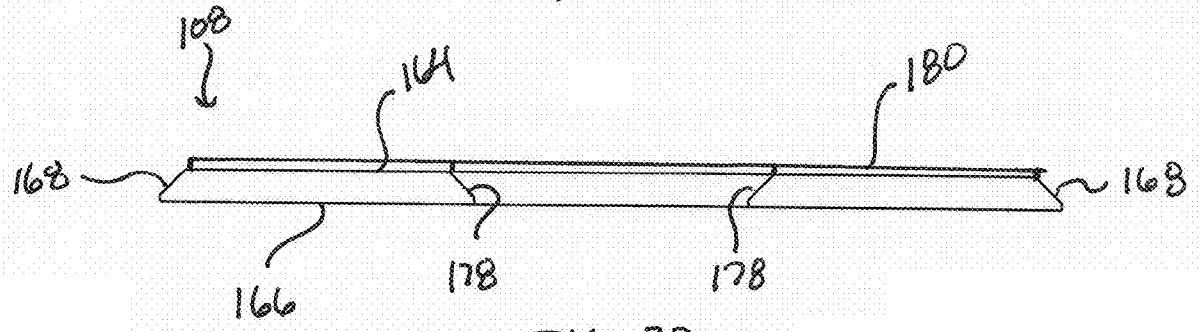

In FIGS. 21 and 22 there is shown a track 108 in accordance with an embodiment of the invention. Track 108 has an elongated configuration with a length greater than its width. The track 108 is also of a thin profile and in some embodiments may have a thickness of about 3 mm or ⅛ inch thick. The track 108 can be made of plastics, and preferably a high strength plastic. However, the track could be made of other materials like metal, alloys, etc.

The track 108 has a broad mounting surface 164, an opposite outward facing surface 166, opposite longitudinal edges 168, a top edge 170, and a bottom edge 172. The track 108 also has a pair of parallel track members 174 and 176, each having inner longitudinal edges 178. The longitudinal edges 168 and 178 taper from the mounting surface toward the outward surface to conform or compliment the dovetail-like profile of the slots 160 and 162 in the base member 102. An adhesive layer 180 is on the mounting surface 164 and is used to adhesively secure or attach the track 108 to the body of a musical instrument. In embodiments, the adhesive layer can be a pressure sensitive and have a protective release layer that is removed for attaching the track the musical instrument. In embodiments, the adhesive layer may be a stretch release type adhesive making removing the track from the musical instrument easier and without damage to the musical instrument.

Figure 23:
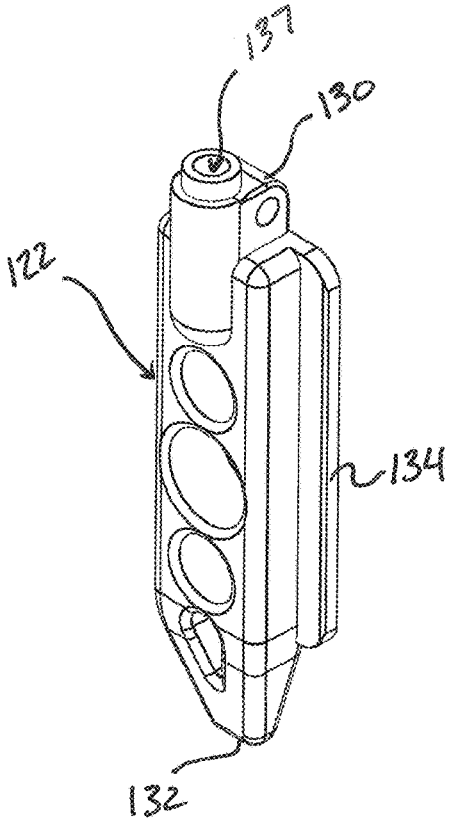
FIG. 23 is a perspective view of a shuttle of the stand of FIG. 15 and is provided in accordance with embodiments of the invention.
Figure 24:
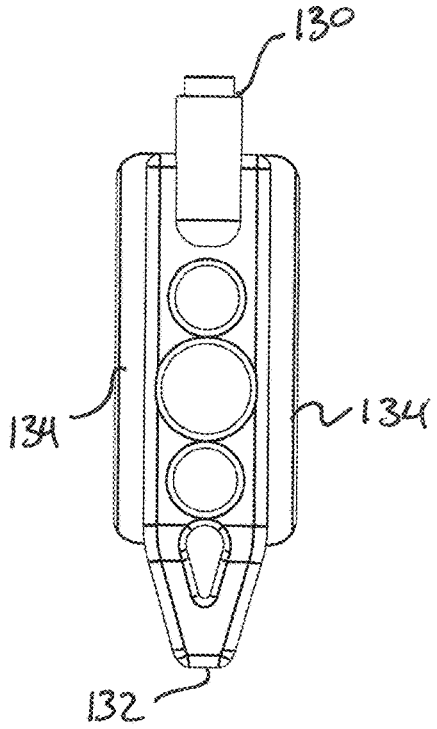
FIG. 24 is a front view of the shuttle of FIG. 23.
Figure 25:
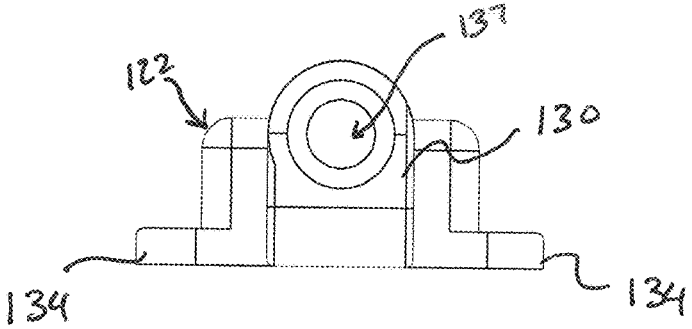
FIG. 25 is a top view of the shuttle of FIG. 23.

In FIGS. 23-25 there is shown the shuttle 122 according to an embodiment of the invention. As discussed above, the shuttle 122 has an inward end 130 and an outward or contact end 132 and a body extending therebetween. Slides 134 are disposed on opposite sides of the body and extend along its longitudinal length. The inward end 130 of the shuttle 112 has a blind bore 137 for receiving an end of the shaft 124. The blind bore 137 is configured such that the shaft is press fit therein to move with the shuttle 122. The shuttle also has passage 182 at its top end 130 for pivot coupling 140 with the link arms 128.

Figure 26:
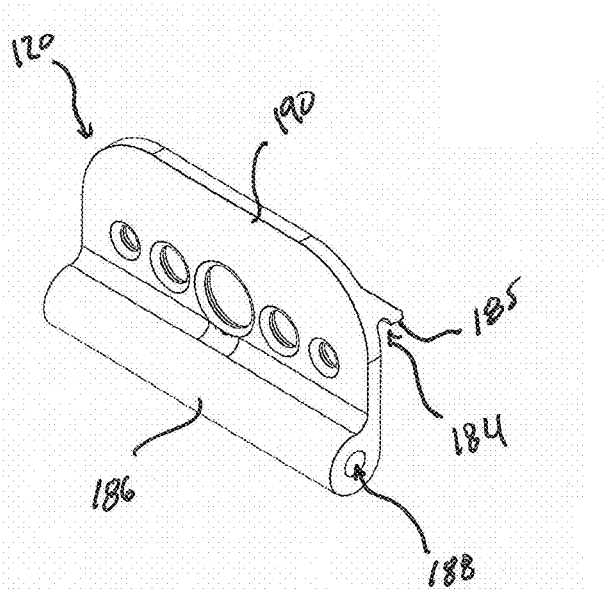
FIG. 26 is a perspective view of a latch of the stand of FIG. 15 and is provided in accordance with embodiments of the invention.
Figure 27:
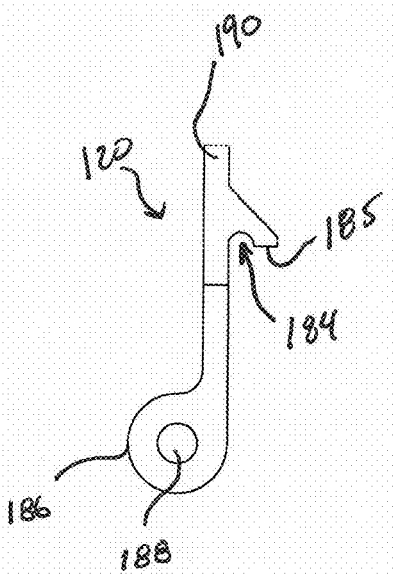
FIG. 27 is a side view of the latch of FIG. 26.
Figure 28:
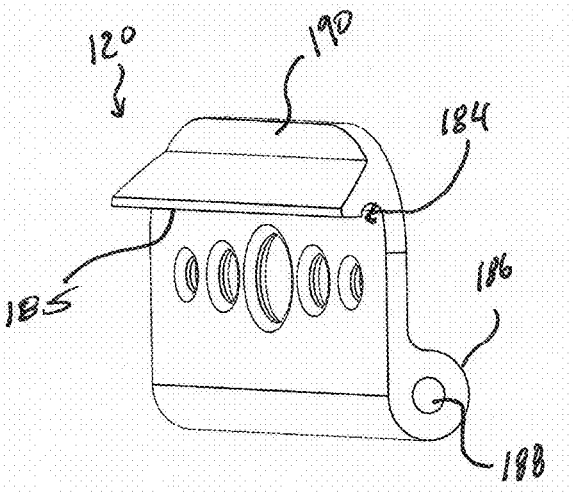
FIG. 28 is a second perspective view of the latch of FIG. 26.

In FIGS. 26-28 there is shown the catch or latch 120 according to an embodiment of the invention. The latch 120 as seen in FIGS. 15 and 16 is rotatably or mounted to the base member 102 for rotation between a latched position and an unlatched position. In the latched position the latch engages the top end of the track to lock it in the slots 160 and 162 of the base member. Particularly, the latch includes a groove 184 that is configured to receive the top edge of the base member 102 of in a snap-lock like fashion. The latch 120 further has a track engagement surface 185 that abuts against the top edge of the track to stop the track from moving out from the slots 160 and 162 and prevent the decoupling of the track and base member. The latch 120 further includes a hinge barrel 186 having a passage or bore 188 for connection with pivot coupling 118. The latch 120 also has a finger pull 190 for operating the latch.

Figure 29:
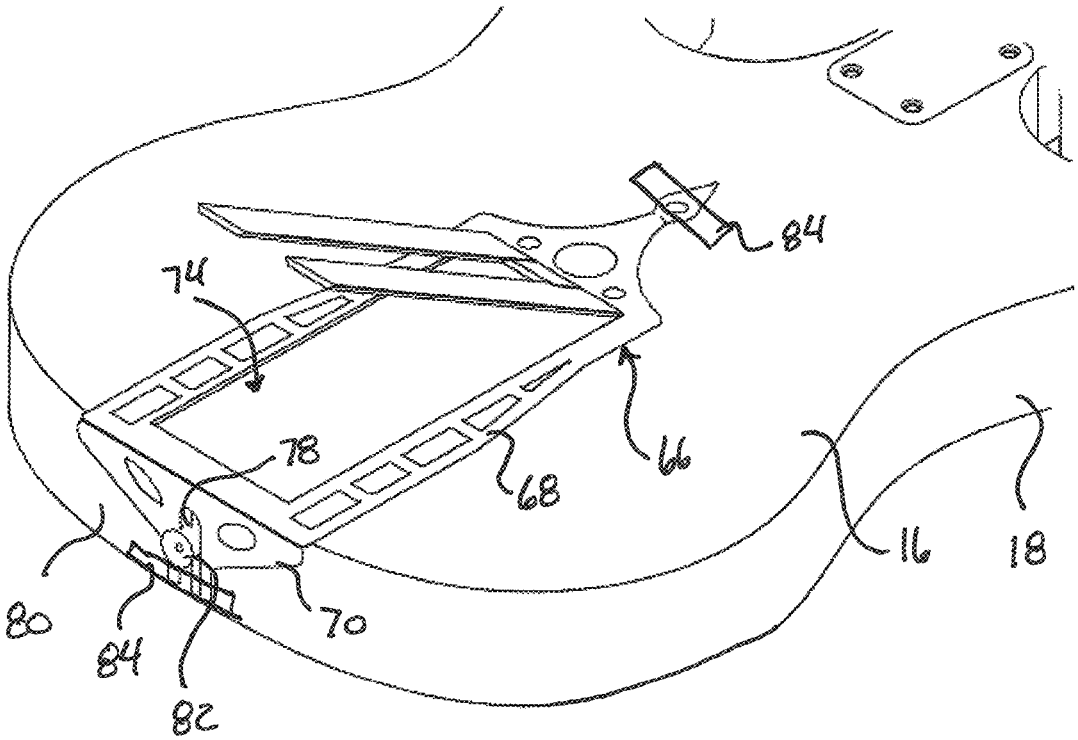
FIG. 29 is a perspective view showing a track being mounted to the back of a musical instrument using the track mounting template.

In FIG. 29 there is a perspective view showing the template 66 in use for attaching the track 108 to the back 16 of the musical instrument body 18, representatively shown as a guitar. The template 66 is arranged on the back 16 of the musical instrument with the upper portion 68 on the back and the lower portion 70 folded over onto the bottom 80 of the musical instrument. The lower portion is aligned with the shoulder strap coupling 82 by positioning the coupling in slot 78. The upper portion 68 is aligned with the center of the back 16 using point 76. The template 66 can be temporality secured in place by using adhesive tape 84.

Once the template 66 is properly aligned, the track 108 can be secured or mounted to the back 16 by aligning it with the opening 74 in the template and pressing it down onto the back to firmly adhere the track to the back by the adhesive. Once the track 108 is mounted, the template can be removed.

Figure 30:
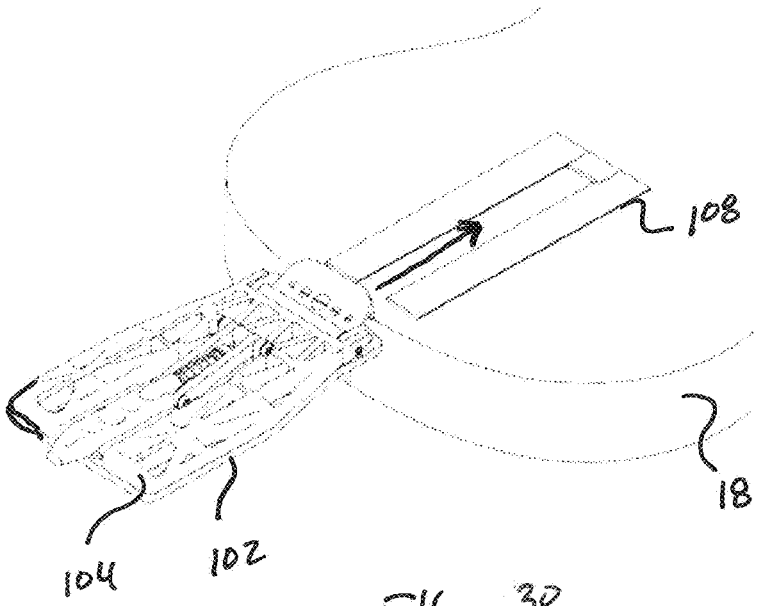
FIG. 30 is a perspective view showing the stand of FIG. 15 being removably attached to a musical instrument by engaging a base member to a track that is mounted to the back of the musical instrument.

In FIG. 30 the base member 102 and attached leg member 104 are shown being coupled to the track 108 by sliding the track into the track slots 160 and 162 (not visible here) of the base member. The base member is slide onto the track 108 with the track being received by the base member in the slots until the track is fully seated.

Figure 31:
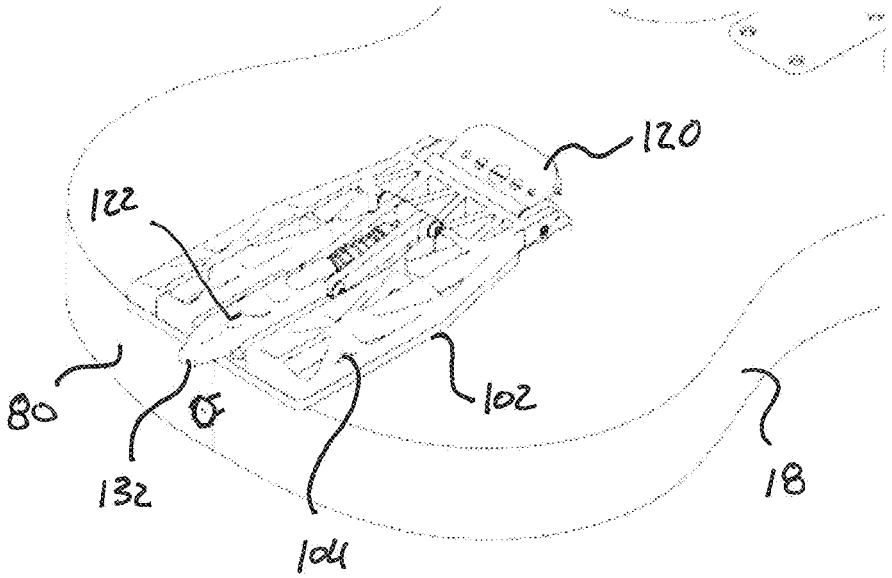
FIG. 31 is a perspective view showing the stand of FIG. 15 removably attached to the musical instrument.

In FIG. 31 the base member and attached leg member 104 are shown with the track 108 fully seated in the slots 160 and 161. While fully seated, the latch 120 can then be pushed downwardly into a snap-locking engagement with the top edge of the track 108, thereby securely coupling the base member 102 and the track. As further shown, the tack 108 is positioned such that when the base member 102 is coupled therewith, the engagement end 132 of the shuttle 122 extends beyond the bottom 80 of the musical instrument. This allows the engagement end 132 of the shuttle to contact the ground as the musical instrument is moved into position upright on the ground, thereby causing the shuttle to move and deploy the leg member 104, as discussed above, to support the musical instrument on the ground.

Figure 32:
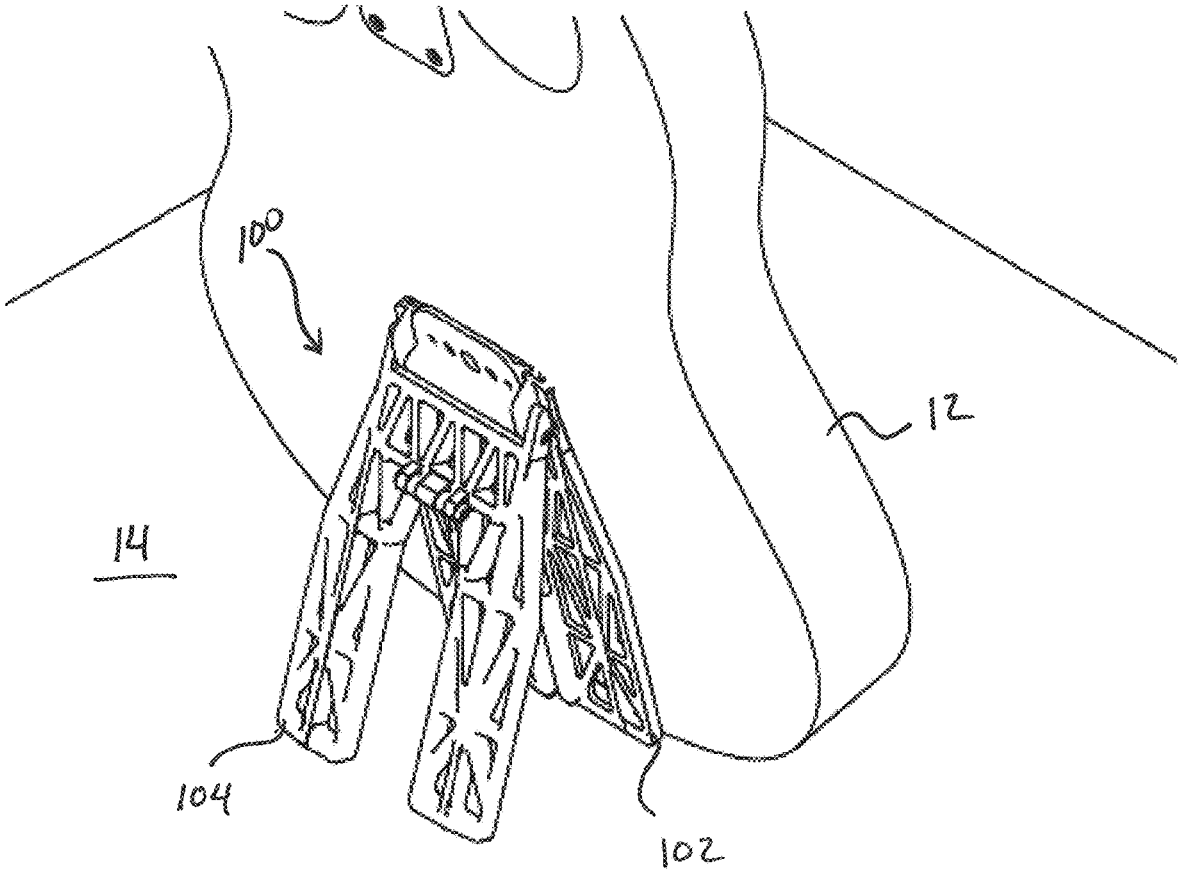
FIG. 32 is a perspective view of the stand of FIG. 31, showing the musical instrument being supported by the stand in an upright standing position, by the deployed leg members of the stand.
Figure 33:
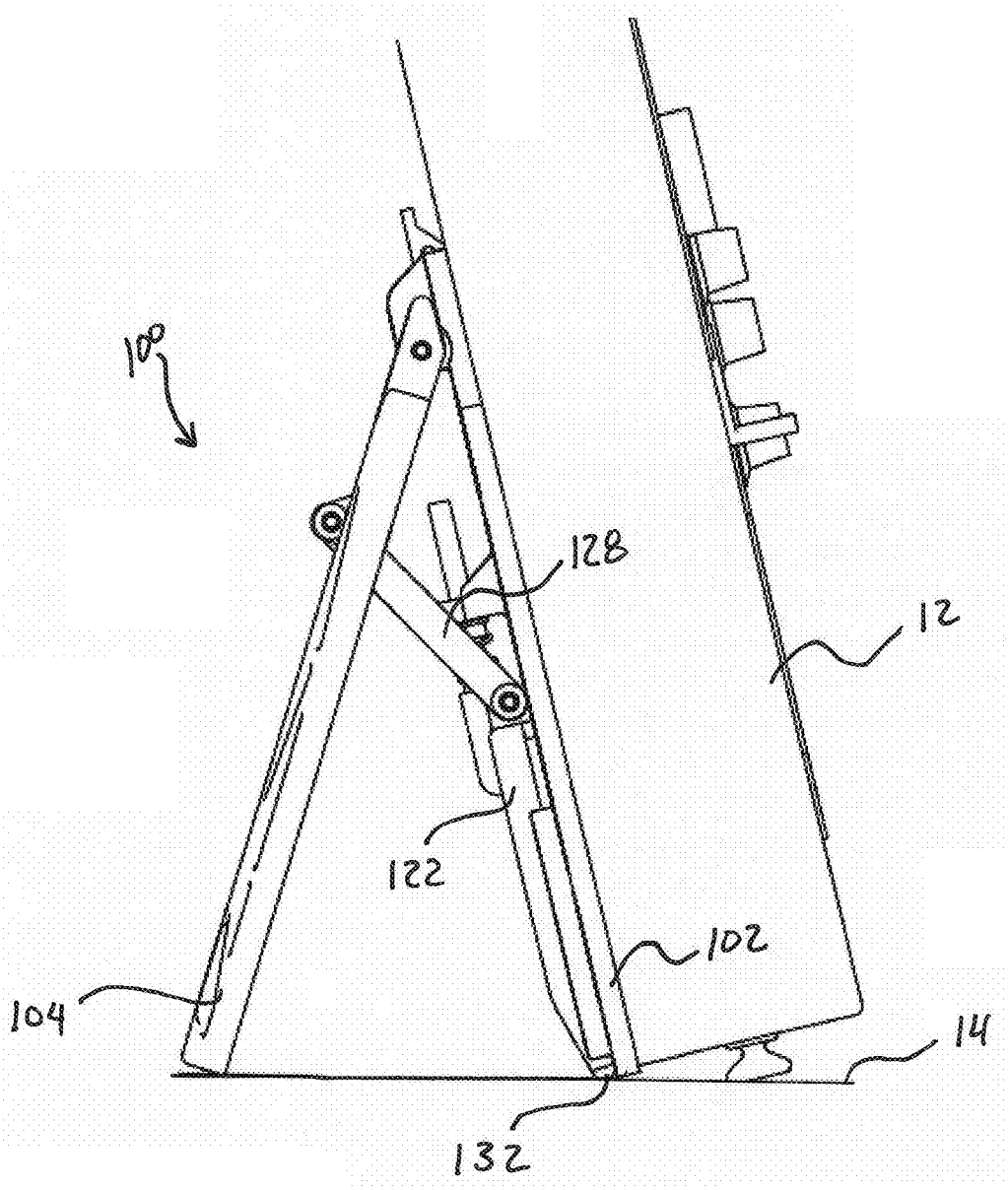
FIG. 33 is a side view of the musical instrument and stand of FIG. 32.

In FIGS. 32 and 33 there is shown a musical instrument 12 supported, upright on the ground 14 by stand 100. As depicted, the leg member 104 is pivoted into the deployed position and is engaged with the ground, providing support to the instrument 12. As best seen in FIG. 33, the shuttle 122 shown engaged with the ground 14 and disposed in its upward position which caused the link arms 128 to pivot the leg member 104 in the position shown. Simply lifting the instrument 12 up off the ground 14 disengages the shuttle 122 from the ground and the spring force against the shuttle causes it to move into its rest position and pivot the leg member 104 inwardly against the base member 102 and into the stowed position (best seen in FIG. 31).

Figure 34:
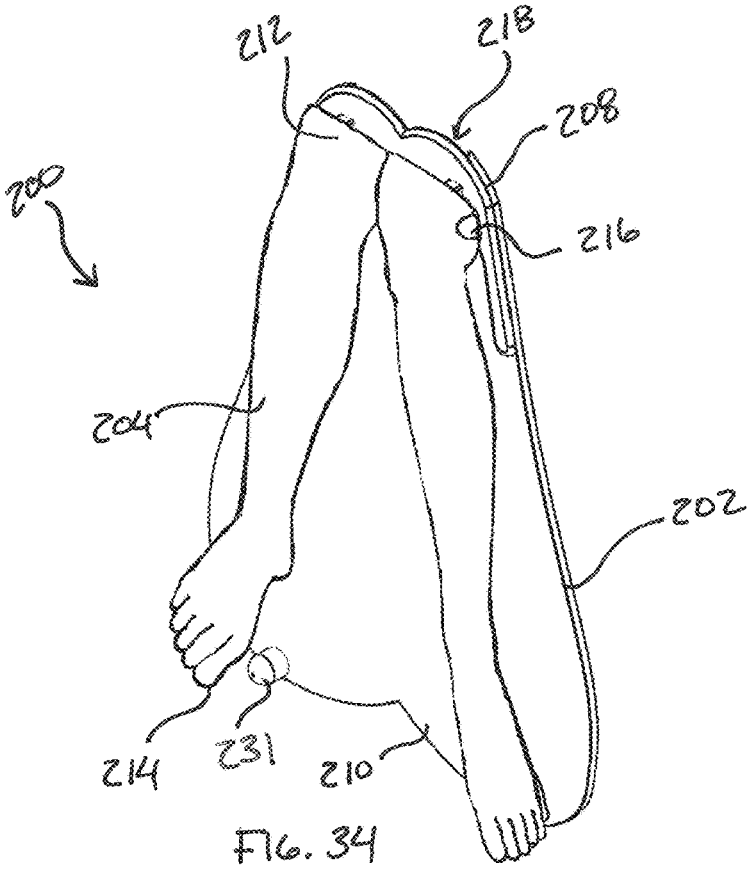
FIG. 34 is a perspective view of a musical instrument stand that is provided in accordance with other embodiments of the invention.

In FIG. 34 there is illustrated a musical instrument stand 200 according to another embodiment of the invention. Stand 200 is like stand 10 discussed above and is manually operated. As depicted, stand 200 includes a base member 202, leg member 204, and a track 206 (Seen in FIGS. 38 and 39).

The base member 202 has a top end 208, a bottom end 210, and a length extending there between. The leg member 204 has a top end 212 and a bottom end 214. The leg member 204 is ornamentally shaped to have a simulative appearance of a pair of human legs. Both the leg member 204 and the base member 202 can be made of plastics, and preferably a high strength plastic. However, the members could be made of other materials like metal, alloys, etc.

The leg member 204 is pivotally connected at its top end 212 to the top end 208 of the base member 206 by pivotal coupling 216. In this manner, the leg member 204 can pivot toward and away from the base member 202 or the musical instrument when attached to a musical instrument between deployed and stowed positions just like the previously described embodiments above.

Figure 35:
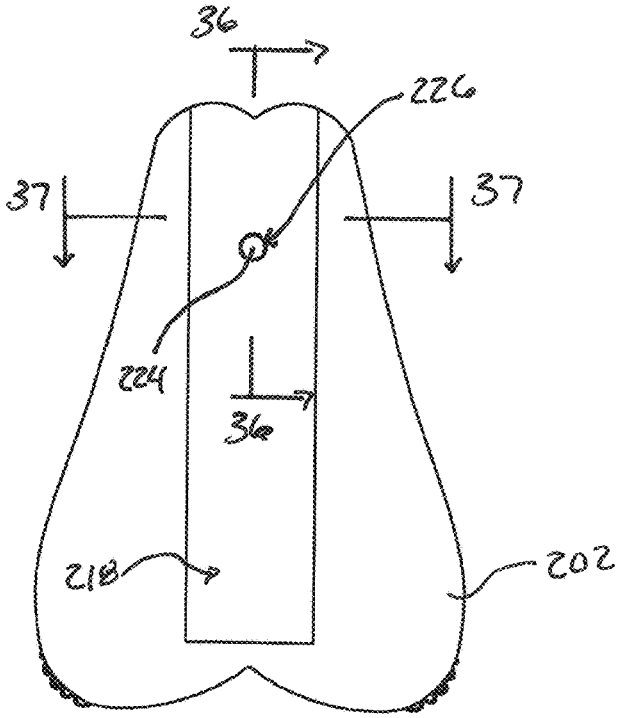
FIG. 35 is a back view of a base member of the musical instrument stand of FIG. 34.
Figure 36:
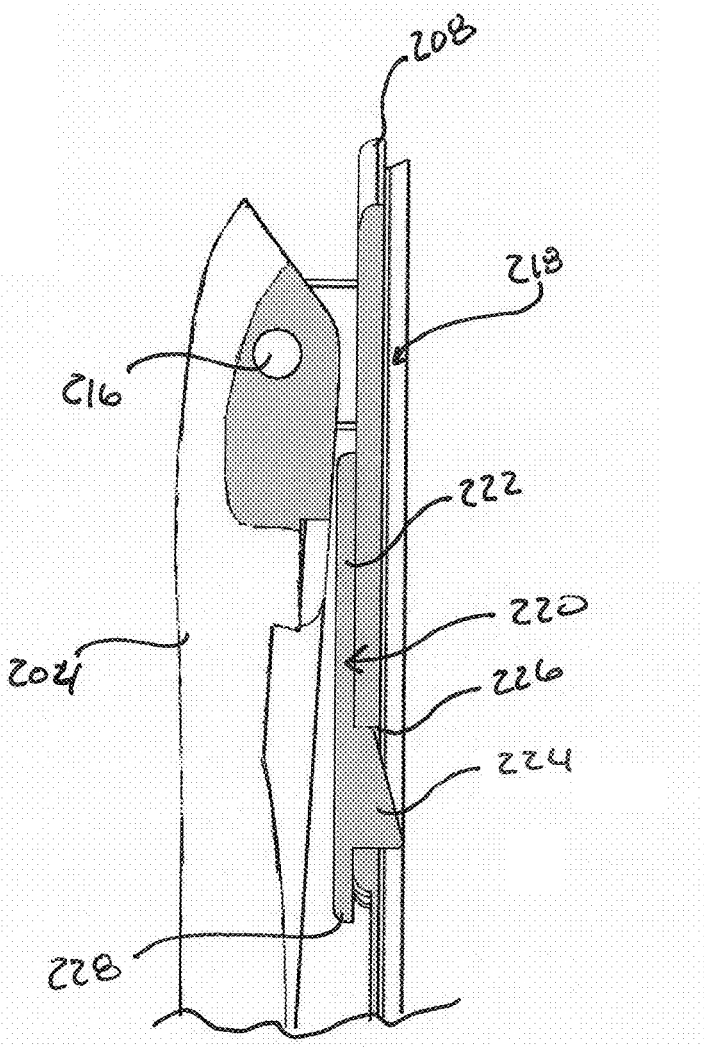
FIG. 36 is a cross-sectional view through the base member taken along line 36-36 in FIG. 35.
Figure 37:
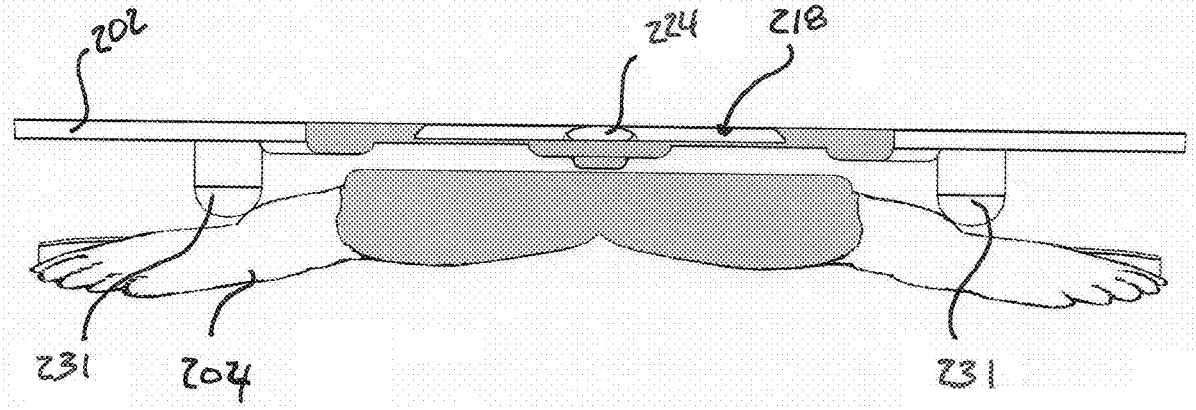
FIG. 37 is a cross-sectional view through the base member taken along line 37-37 in FIG. 35.

With reference to FIGS. 35-37, the base member 202 has a slot 218 for receiving the track 206. The slot 218 is open at the top 208 of the base member 202 and terminates at a closed end toward the bottom 210 of the base member. The slot 218 can be configured to have a dovetail-like cross-section that complements the track profile to securely retain the track in the slot. It should be noted, however, other slot profiles could be used to achieve the same result of sliding coupling the track and the base member and the profile should not be limited to just a dovetail-like coupling between the track and the base member.

The base member has a catch 220 that engages with the top edge of the track 206 when the track is fully received into the slot 218 to prevent the track from backing out of the slot and decoupling the base member and track. The catch 220 includes a tab 222 and tapered latch 224. The tab 222 is attached to the base member 220 and the latch 224 extends through a hole 226 through the base member and projects into the slot 218. The taper of the latch 224 is such that it tappers from narrow to wide in the track insertion direction into the slot 218. The catch 220 is resilient thus when the track is inserted into the slot 218, the track presses against the latch 224 and biases the latch out of the way until the top of the track passes the latch. Once the top of the track passes the latch 224, the latch returns to its rest position, locking the track in place in the slot 218. To release the track, the catch 220 includes a finger pull 228 that can be lifted to pull the latch 224 out of the slot and allow the track to pass.

The base member 202 further has a pair of ground supports 230 that disposed toward the bottom edge of the base member project outward from its front side. The ground supports 231 provide a bearing surface for the base member against the ground when the stand is used to support the musical instrument.

Figure 38:
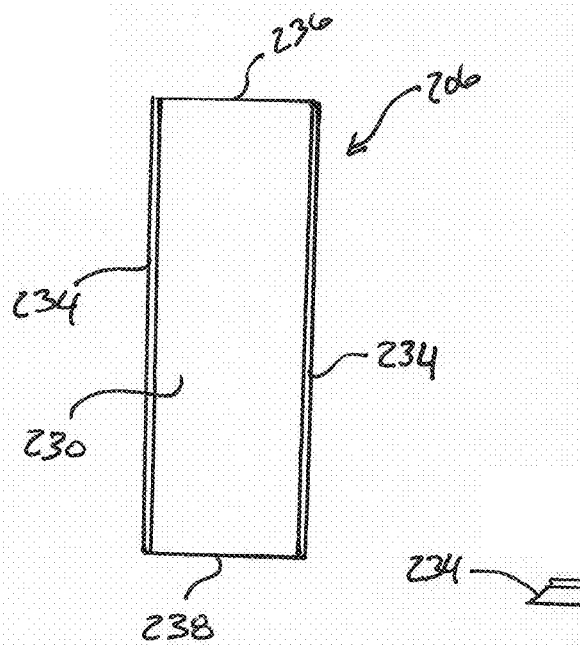
FIG. 38 is a back view of a track that is provided in accordance with embodiments of the invention.
Figure 39:
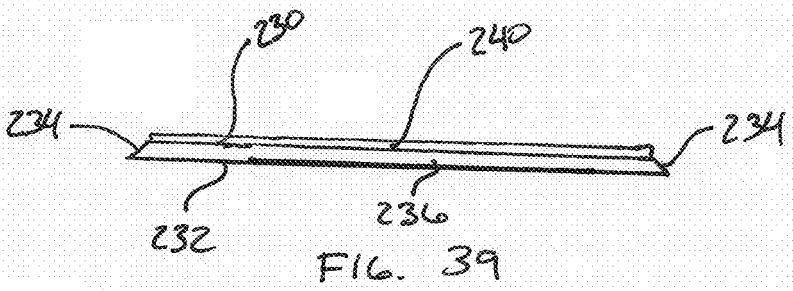
FIG. 39 is a top view of the track of FIG. 38.

In FIGS. 38 and 39 there is shown a track 206 in accordance with an embodiment of the invention. Track 206 has an elongated configuration with a length greater than its width. The track 206 is also of a thin profile and in some embodiments may have a thickness of about 3 mm or ⅛ inch thick. The track 206 can be made of plastics, and preferably a high strength plastic. However, the track could be made of other materials like metal, alloys, etc.

The track 206 has a broad mounting surface 230, an opposite outward facing surface 232, opposite longitudinal edges 234, a top edge 236, and a bottom edge 238. The longitudinal edges 234 taper from the mounting surface toward the outward surface to conform or compliment the dovetail-like profile of the slot 218 in the base member 202. An adhesive layer 240 is on the mounting surface 230 and is used to adhesively secure or attach the track 206 to the body of a musical instrument. In embodiments, the adhesive layer can be a pressure sensitive and have a protective release layer that is removed for attaching the track the musical instrument. In embodiments, the adhesive layer may be a stretch release type adhesive making removing the track from the musical instrument easier and without damage to the musical instrument.

Figure 40:
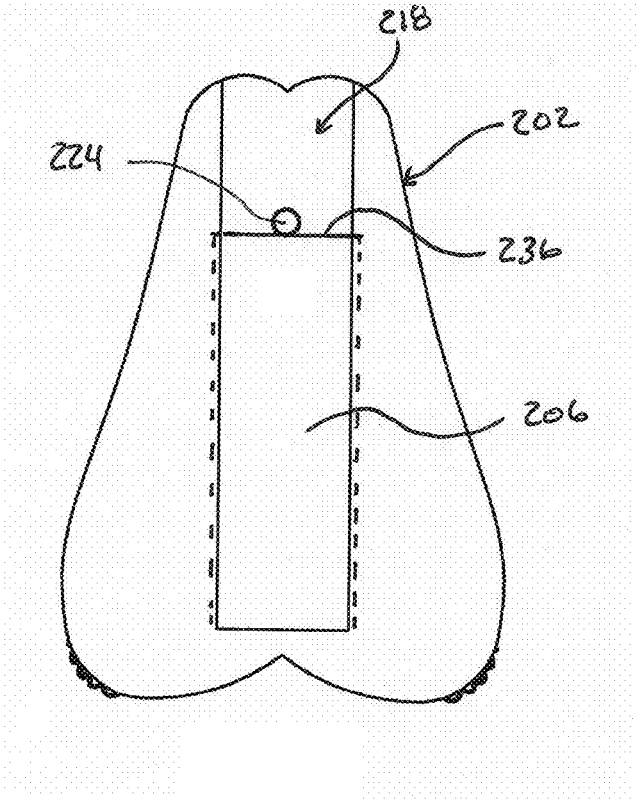
FIG. 40 is a back view of the base member showing the track coupled with the base member.

In FIG. 40 there is shown a back view of the base member 202 showing the track 206 received by the slot 218 for the purpose of illustrating the latch 224 engaging with the top 236 of the track, thereby preventing the track from sliding out of the slot and decoupling the base member and track.

While not shown, the track 206 would be attached to the back of a musical instrument in the same manner as discussed above in reference to the previously described embodiments. Additionally, the stand 200 operates in the same manner as stand 10 discussed above and therefor a discussion of its operation is not necessary here.

It will be appreciated by persons skilled in the art that the present embodiment is not limited to what has been particularly shown and described hereinabove. A variety of modifications and variations are possible in light of the above teachings without departing from the following claims.

What is claimed is:

1. A musical instrument stand for supporting a musical instrument, the instrument stand comprising:

a track having an attachment surface carrying an adhesive layer for adhesively securing the track to a body of the musical instrument;

a base member having a slot configured to slidably receive the track to removably couple the base member and track; and a leg member pivotally coupled to the base member, wherein the leg member can be pivoted away from the base member to support the instrument in a standing position and pivoted toward the base member into a stowed position wherein the leg member lays against the base member.

2. The instrument stand of claim 1, wherein the base member has a latch that releasably engages with the track when the track is fully received by the base member to prevent the track and base member from decoupling.

3. The instrument stand of claim 2, wherein the latch is disposed at a top end of the base member and is configured to resiliently engage a top edge of the track.

4. The instrument stand of claim 1, wherein the track has opposite longitudinal edges that are tapered and wherein the base member has a track slot that is configured to sliding receive the longitudinal edges of the track.

5. The instrument stand of claim 1, wherein the base member has a recess and wherein the leg member is received by the recess when the leg member is pivoted into the stowed position.

6. The instrument stand of claim 1, further comprising:

a leg operator configured to automatically pivot the leg away from the instrument when the instrument is placed in a standing position upon a ground surface, the leg operator comprising:

a shuttle slidably mounted to the base member for reciprocation along the base member in a longitudinal direction between first and second shuttle positions, the shuttle having a top end and a bottom end;

a spring mounted to the base member and biasing the shuttle into the first position;

a linkage pivotally connected at one end to the top end of the shuttle and pivotally connected at a second end to the leg member; and wherein moving the shuttle from the first position to the second position operates the linkage thereby causing the leg member to pivot away from the instrument.

7. The instrument stand of claim 6, wherein:

the leg operator further includes a shaft mounted to the base, one end of the shaft sliding received by a passage formed in the top end of the shuttle, the shuttle being reciprocated along the shaft; and wherein the spring is a coil spring and is captively held about the shaft.

8. The instrument stand of claim 7, wherein the linkage of the leg operator has a pair of link arms, each having one end pivotally connected to the top end of the shuttle and a second end pivotally connected to the leg member.

9. The instrument stand of claim 7, wherein the leg member has first and second legs that are separated defining a space therebetween, and wherein the shuttle disposed in the space between the first and second legs.

10. The instrument stand of claim 1, further comprising:

a track mounting template that can be temporarily attached to the body of the musical instrument and configured to locate the track relative to the body of the musical instrument for attaching track to the body of the musical instrument.

11. The instrument stand of claim 10, wherein the track mounting template has a bottom portion and a top portion, the bottom portion being foldable relative to the top portion, and the top portion having an aperture for receiving the track therethrough.

12. The instrument stand of claim 1, further comprising:

a latch pivotally mounted to the base member and configured to make a snap-lock engagement with the base member and a track engagement surface that blocks withdrawal of the track from the slot when the latch is latched to the base member.

13. The instrument stand of claim 12, wherein the latch has a lateral groove that is configured to receive the top edge of the base member in a snap-lock engagement.

14. A musical instrument stand for supporting a musical instrument, the instrument stand comprising:

a track having an attachment surface carrying an adhesive layer for adhesively securing the track to a body of the musical instrument;

a base member configured to slidably receive the track to removably couple the base member and track;

a leg member pivotally coupled to the base member, wherein the leg member can be pivoted away from the base member to support the instrument in a standing position and pivoted toward the base member into a stowed position wherein the leg member lays against the base member;

the base member has a latch that releasably engages with the track when the track is fully received by the base member to prevent the track and base member from decoupling; and wherein the track has opposite longitudinal edges that are tapered and wherein the base member has a track slot that is configured to sliding receive the longitudinal edges of the track.

15. The instrument stand of claim 14, wherein the base member has a recess and wherein the leg member is received by the recess when the leg member is pivoted into the stowed position.

16. The instrument stand of claim 14, wherein the leg member has legs that are simulatively shaped as human legs.

17. The instrument stand of claim 14, further comprising:

a leg operator configured to automatically pivot the leg away from the instrument when the instrument is placed in a standing position upon a ground surface, the leg operator comprising:

a shuttle slidably mounted to the base member for reciprocation along the base member in a longitudinal direction between first and second shuttle positions, the shuttle having a top end and a bottom end;

a spring mounted to the base member and biasing the shuttle into the first position;

a linkage pivotally connected at one end to the top end of the shuttle and pivotally connected at a second end to the leg member;

wherein moving the shuttle from the first position to the second position operates the linkage thereby causing the leg member to pivot away from the instrument;

wherein the linkage of the leg operator has a pair of link arms, each having one end pivotally connected to the top end of the shuttle and a second end pivotally connected to the leg member; and wherein the leg member has first and second legs that are separated defining a space therebetween, and wherein the shuttle disposed in the space between the first and second legs.

18. The instrument stand of claim 14, wherein the latch is pivotally mounted to the base member and configured to make a snap-lock engagement with a top edge of the base member and a track engagement surface that blocks withdrawal of the track from the slots when the latch is latched to the base member.

19. The instrument stand of claim 18, wherein the latch has a lateral groove that is configured to receive the top edge of the track in a snap-lock engagement.

20. The instrument stand of claim 14, wherein the latch has a catch that extends through a hole in base member and projects into the slot, and the catch tappers from narrow to wide in a track insertion direction.

* * * * *